US010086379B2

(12) United States Patent
Hoffmann

(10) Patent No.: US 10,086,379 B2
(45) Date of Patent: Oct. 2, 2018

(54) ROTARY MILL

(71) Applicant: Aaron Engineered Process Equipment, Inc., Bensenville, IL (US)

(72) Inventor: Jeffrey R. Hoffmann, Schaumburg, IL (US)

(73) Assignee: AARON ENGINEERED PROCESS EQUIPMENT, INC., Bensenville, IL (US)

( * ) Notice: Subject to any disclaimer, the term of this patent is extended or adjusted under 35 U.S.C. 154(b) by 889 days.

(21) Appl. No.: 14/633,380

(22) Filed: Feb. 27, 2015

(65) Prior Publication Data

US 2016/0250647 A1 Sep. 1, 2016

(51) Int. Cl.
*B02C 17/10* (2006.01)
*B02C 17/18* (2006.01)

(52) U.S. Cl.
CPC ..... *B02C 17/10* (2013.01); *B02C 17/1835* (2013.01)

(58) Field of Classification Search
CPC ..... B02C 17/10; B02C 17/18; B02C 17/1835
USPC ..... 241/79.1, 176, 172
See application file for complete search history.

(56) References Cited

U.S. PATENT DOCUMENTS 944,997 A * 12/1909 Abbe ..... B02C 17/161 241/176
1,430,432 A * 9/1922 Bittner ..... B02C 17/04 241/176
1,440,002 A * 12/1922 Bradley ..... B02C 17/06 241/176
2,056,583 A * 10/1936 Moussette, Sr. ..... B02C 17/10 241/176
2,074,233 A * 3/1937 Moussette, Sr. ..... B02C 17/18 209/290
2,174,630 A * 10/1939 Harlowe ..... B02C 17/00 209/139.1
2,486,477 A * 11/1949 Kennedy ..... B02C 17/18 184/6.12
2,681,210 A * 6/1954 Schaefer ..... B01F 9/02 241/176
3,146,557 A * 9/1964 Smith ..... B24B 31/02 241/176

(Continued)

FOREIGN PATENT DOCUMENTS

CN 201543470 U 8/2010
CN 201969598 U 9/2011

(Continued)

*Primary Examiner* — Faye Francis
(74) *Attorney, Agent, or Firm* — Barnes & Thornburg LLP; G. Peter Nichols

(57) ABSTRACT

A rotary milling system includes a rotatable body having a cylindrical portion and at least one variable diameter portion. The variable diameter portion is tapered toward an opening in a sidewall of the rotatable body a discharge grate. The body can include grinding media for abrading a product when the body is rotated. The product can be milled as a dry product or within a liquid medium. The tapered shape of the body urges milled product toward the opening and the discharge grate. The system can include a discharge housing surrounding the discharge grate and a conveying pipe in fluid communication with the discharge housing, with a valve disposed between the conveying pipe and the discharge to selectively allow milled product to be conveyed through the conveying pipe.

18 Claims, 11 Drawing Sheets

(56) References Cited

U.S. PATENT DOCUMENTS 3,272,444 A * 9/1966 Rich ..... B02C 17/24 241/176
3,837,301 A * 9/1974 Falling ..... F23J 1/00 110/194
3,884,420 A * 5/1975 Kops ..... B02C 17/181 241/176
3,894,692 A * 7/1975 Sanko ..... B02C 17/00 241/176
3,949,940 A * 4/1976 Horning ..... B02C 17/06 241/176
4,744,525 A 5/1988 De La Orden
4,776,522 A * 10/1988 Hoffmann ..... B02C 17/166 241/176
4,867,322 A 9/1989 Bogdanov et al.
5,492,278 A * 2/1996 Raboin ..... B02C 19/0068 241/152.2
5,873,532 A * 2/1999 Fontanille ..... B02C 17/1845 241/171
5,954,276 A 9/1999 Hintikka et al.
7,374,115 B2 5/2008 Geiger et al.
9,505,008 B2 * 11/2016 Nied ..... B02C 17/161
2011/0121115 A1 5/2011 Lang et al.
2012/0325944 A1 12/2012 Knobel

FOREIGN PATENT DOCUMENTS

CN 202867565 U 4/2013
CN 202983794 U 6/2013
DE 3318826 A1 11/1984
DE 19750840 A1 6/1998
ES 2004981 A6 2/1989
RU 2291746 C1 1/2007
WO 90/07378 A1 7/1990

* cited by examiner

Fig. 3
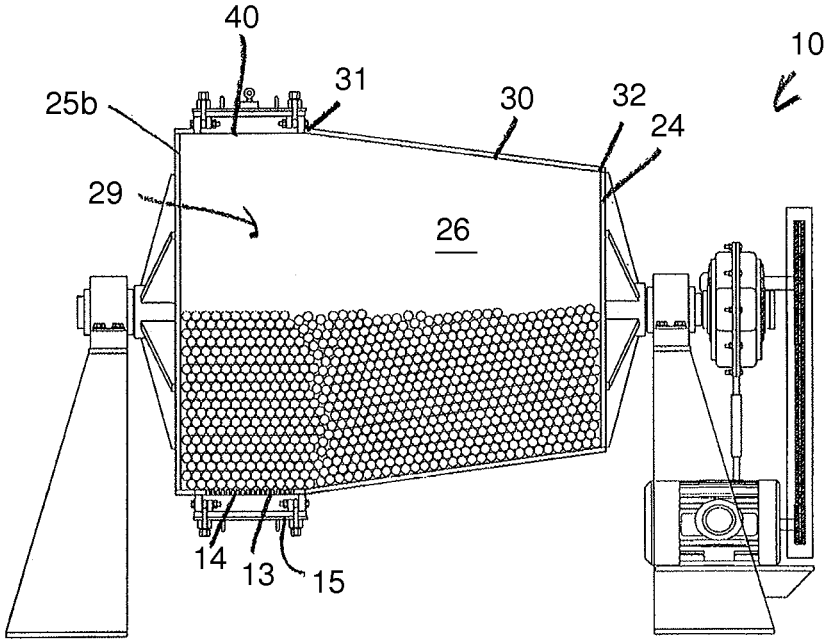
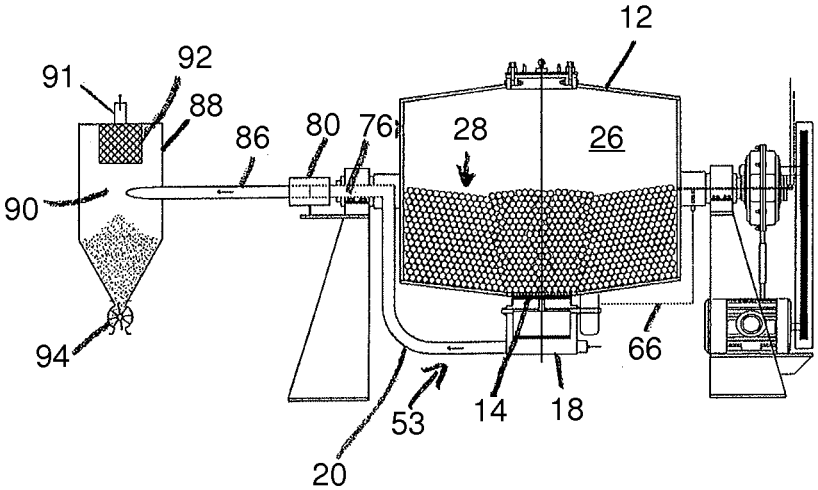
Fig. 4

First Critical Speed

Second Critical Speed $N^{th}$ Critical Speed

ROTARY MILL

BACKGROUND

The present invention relates to rotary mills. More particularly, the invention relates to a rotary mill with a rotating housing having a conical portion.

Rotary mills, also known as ball mills, pebble mills, rod mills, or tumble mills, are well known in the art. A traditional rotary mill includes a horizontal rotating cylinder or housing that rotates about a central axis. The cylinder includes grinding media that is generally spherical, cylindrical, or another shape. In the case of milling with a liquid medium, solid target materials are placed along with a liquid medium into the cylinder for milling. In the case of dry milling (without a liquid medium), the solid target materials are placed in the cylinder to be ground by the grinding media. The cylinder is rotated, causing the grinding media to tumble along with the target material, with the grinding media abrading and impacting the solid target materials. Continued rotation of the cylinder produces a milled product in the form of particles. In the case of milling with a liquid medium, the particles are suspended in the liquid. In the case of dry milling, the particles settle within the cylinder and between the grinding media.

Upon completion of the milling process, the milled product is discharged from the cylinder. The mill includes an opening with a solid cover. One method of discharge is known as dumping, and includes opening a solid cover of the cylinder and the milled solids and grinding media are dumped from the mill together out of the opening. The milled solids can then be separated with an ancillary device such as a stationary grate, vibrating sifter, or the like.

Another method of discharge is dry discharge, where the milled solids are separated from the grinding media and removed. The solid cover then can be manually removed and replaced with a discharge grate, which will retain the grinding media but allow the milled product to pass through the opening. Because the grinding media restricts the flow of the solids, the mill continues to rotate, so that existing solids will create a void space after exiting the cylinder and further solids will then fill the void space for subsequent discharge. This continues until most of the solids are removed.

In the case of a liquid milled product, a method of wet discharge can be used, which includes the grate for retaining the grinding media. The cylinder can remain stationary if the liquid suspending the product is a low-viscosity fluid, the liquid can flow past the media due to gravity. If, however, the liquid is a non-Newtonian or a high-viscosity liquid, the cylinder can be rotated to discharge the milled product.

The rotary mill also includes a discharge housing that surrounds the rotating cylinder to define an annular space between the cylinder and the housing. The housing also includes a collection hopper at its bottom. When the milled product is discharged, as described above, the milled product will enter the annular space and fall into the hopper.

However, the above discharge process can result in dirty conditions, with milled product adhering to the inner surface of the housing as well as the outside of the cylinder. Retrieval of the milled product from the discharge housing can also result in milled product entering the surrounding area. These conditions can reduce the amount of milled product recovered, as well as lead to cross-contamination issues and cleaning problems. In the case of liquid milling, the operator must make and break a liquid piped connection to the discharge housing, exposing the milled product and potential solvent vapors to the surrounding area during this break in the connection.

Additionally, it is difficult to adequately remove all of the milled product in the above described discharge methods. Milled product will tend to adhere to the inner surface of the cylinder as well as to the surfaces of the grinding media. This can lead to cross-contamination issues, which results when one batch of product is not fully discharged before the next batch is loaded, when the next batch is a different milled product. The residual product from the previous milling procedure can therefore become mixed with the subsequent product. The residual product in the cylinder is generally referred to as the "heel."

One method for avoiding cross-contamination is to use separate mills for separate milled products. But this solution is costly and requires multiple dedicated mills, and is not feasible for many users.

There are acceptable levels of cross-contamination for various milling jobs, but the level that is acceptable varies and can only be defined by the particular requirements of each project.

Ball mills are typically not well suited for low cross-contamination because the grinding media itself provides a large surface are for the finely divided solids to adhere to, and further because the mill housing is in the form of a horizontally arranged cylinder. The cylindrical shape of the horizontally arranged cylinder results in product that becomes "trapped" at the ends of the cylinder. Due to the cylindrical shape of the mill housing and the horizontal orientation of the cylinder, the only force acting on a milled particle within the cylinder (gravity) is normal to the inner surface of the horizontal cylinder. Thus, there are no forces acting on the particles to move them horizontally.

When discharging dry solids from a horizontal mill cylinder, as described above, the dry solids exit the cylinder via a grate located on the periphery of the cylinder. The grate is typically arranged in the middle of the cylinder. Once most of the dry solids have been discharged, the remaining solids in the cylinder move more and more slowly toward the discharge grate. At this point, the movement toward the grate can be described as "random walk" or "Gaussian random walk." For all practical purposes, the last of the solids do not exit the mill. The amount of time necessary to actually discharge all of the solids can be referred to as the "long tail" in reference to the tail of an exponential curve of the amount of solids discharged over time, where most of the solids are discharged early in the process, and the remaining solids are discharged more and more slowly over time.

Over an infinite period of time, all of the solids would eventually be removed. However, that is not reasonable. And even an extended period of rotating the mill to discharge more solids has disadvantages. The energy of tumbling the grinding media remains relatively constant even when there is no product left to be milled. As soon as discharge begins, the grinding media becomes more and more exposed to other grinding media. With fewer solids present, because they are being discharged, the energy of the grinding media is imparted onto other grinding media because the solids are no longer between the grinding media. Thus, extended rotation to remove more solids results in accelerated wear on the grinding media. Accelerated wear on the grinding media therefore requires that the media be replaced earlier and more frequently. Moreover, the additional wear on the grinding media results in grinding media material mixing the milled product.

Accordingly, allowing the cylinder to be rotated for extended periods of time to increase the amount of discharge and reduce the "heel" results in significant media wear and additional cross-contamination issues. Similar issues exist with liquid milling procedures.

Thus, there is a need for a discharge system that can reliably deliver the milled product from the cylinder more quickly and more completely.

SUMMARY

A rotary milling system is provided that includes a rotatable body having a sidewall, a first end wall, and a second end wall that define a central longitudinal axis. The body includes a cavity configured to retain grinding media. The sidewall includes a cylindrical portion and a variable diameter portion having an inner end and an outer end. The variable diameter portion extends longitudinally between the cylindrical portion and the first end wall. The inner end of the variable diameter portion is disposed at the cylindrical portion and the outer end of the variable diameter portion is disposed at the first end wall. An opening is provided through the cylindrical portion of the sidewall to allow milled product to pass through. The cylindrical portion has a first diameter and the first end wall has a second diameter, such that the first diameter is greater than the second diameter. The opening is located radially further from the longitudinal axis than the outermost peripheral surface of the outer end of the variable diameter portion. The diameter of the variable diameter portion decreases as it extends from the cylindrical portion to the first end wall. The variable diameter defines a slope from the outer end toward the inner end to urge the grinding media and the milled product longitudinally toward the cylindrical portion and the opening.

In a further aspect, the system includes a discharge grate attached the cylindrical portion and extending across the opening to retain the grinding media within the body while allowing milled product to pass through.

In another aspect, the system includes a removable cover mounted to the opening to seal the opening and prevent grinding media and milled product from exiting the cavity when installed and to permit grinding media and milled product to exit the body when removed.

In yet another aspect, the system includes a discharge housing surrounding the discharge grate and defining a cavity. A valve is connected to an outlet of the discharge housing. The valve is moveable between a closed position and an open position to selectively allow liquid medium and suspended solids to pass through the valve when open, while preventing passage when closed. A conveying pipe is in fluid communication with an outlet side of the valve, and a liquid-drawing apparatus is operatively associated with the conveying pipe and disposed downstream of the discharge housing to draw liquid medium in the conveying pipe away from the discharge housing.

In another aspect, the second end wall has a diameter approximately equal to the diameter of the cylindrical portion.

In yet another aspect, the cylindrical portion and opening are disposed adjacent the second end wall.

In another aspect, the variable diameter portion is a first variable diameter portion. In this aspect, the system further includes a second variable diameter portion having an inner end and an outer end, with the second variable diameter portion extending from the cylindrical portion to the second end wall.

In yet another aspect, the cylindrical portion and the opening are disposed at the longitudinal middle between the first and second end walls.

In another aspect, the first and second variable diameter portions are disposed on opposite sides of the cylindrical portion and are symmetrical relative to the cylindrical portion.

In a further aspect, the variable diameter portions have different longitudinal lengths.

In another aspect, the variable diameter portions have different shapes defining different slopes toward the cylindrical portion.

In another approach, the system includes a discharge housing attached to the body and surrounding the discharge grate and defining a cavity. A flap is disposed within the discharge housing and is moveable between a closed position covering the opening of the discharge grate and an open position away from the opening. A conveying pipe is in fluid communication with the housing, and a negative pressure producing vacuum member is operatively associated with the conveying pipe to create a negative pressure within the conveying pipe.

In another approach, a rotary milling system for using grinding media to create a milled product is provided. The system includes a rotatable body having a sidewall, a first end wall, and a second end wall to define a central longitudinal axis. The body includes a cavity configured to retain grinding media. The sidewall includes a cylindrical portion and a variable diameter portion having an inner end and an outer end. The variable diameter portion extends longitudinally between the cylindrical portion and the first end wall. The inner end of the variable diameter portion is disposed at the cylindrical portion and the outer end of the variable diameter portion is disposed at the first end wall. The system further includes an opening provided through the cylindrical portion of the sidewall to allow milled product to pass. The cylindrical portion has a first diameter and the first end wall has a second diameter, such that the first diameter is greater than the second diameter. The opening is located radially further from the longitudinal axis than the outer end of the variable diameter portion. The diameter of the variable diameter portion decreases as it extends from the cylindrical portion to the first end wall. The variable diameter defines a slope from the outer end toward the inner end to urge the grinding media and the milled product longitudinally toward the cylindrical portion and the opening.

The system further includes a discharge grate attached the cylindrical portion and extending across the opening to retain the grinding media within the body while allowing milled product to pass therethrough. The system further includes a discharge housing attached to the body and surrounding the discharge grate and defining a cavity therein. The system further includes a conveying pipe operatively coupled to the discharge housing for conveying milled product from the body via a flow path. The system further includes a valve having an open position and a closed position, the valve being disposed in the flow path between the conveying pipe and the discharge grate. Milled product is prevented from being conveyed through the conveying pipe when the valve is in the closed position and allowed to be conveyed through the conveying pipe when the valve is in the closed position.

In another aspect, the system includes a rotary union connected with the conveying pipe.

In yet another aspect, the system further includes a milled product conveying apparatus in fluid communication with the conveying pipe for drawing milled product through the conveying pipe when the valve is in an open position, and a separator tank in fluid communication with the conveying pipe for receiving the conveyed milled product.

In yet another aspect, the system includes a secondary pipe connected to the rotary union, wherein the rotary union couples the secondary pipe and the conveying pipe and the secondary pipe is disposed between the separator tank and the conveying pipe.

In another approach, a rotary milling system for using grinding media to create a milled product includes a rotatable body having a sidewall, a first end wall, and a second end wall, the body defining a cavity and a central longitudinal axis, the rotatable body configured to retain grinding media therein, the sidewall including a cylindrical portion and a variable diameter portion having an inner end and an outer end, wherein the variable diameter portion extends longitudinally between the cylindrical portion and one of the first end wall, the inner end of the variable diameter portion being disposed at the cylindrical portion and the outer end of the variable diameter portion being disposed at the first end wall. The system further includes an opening provided through the cylindrical portion of the sidewall to allow milled product to pass therethrough, and a discharge grate extending across the opening to retain grinding media within the body. The cylindrical portion has a first diameter and the first end wall has a second diameter, and the first diameter is greater than the second diameter. When the body is oriented such that the opening and discharge grate are at the bottom of the body, the opening and discharge grate are located below the outer end of the variable diameter portion.

In another aspect, the diameter of the variable diameter portion decreases as it extends from the cylindrical portion to the first end wall, and the variable diameter defines a slope from the outer end toward the inner end to urge the grinding media and the milled product longitudinally toward the cylindrical portion and the opening.

In yet another aspect, the perimeter of the body rotates at a greater linear speed along the cylindrical portion relative to the linear speed of the body at the variable diameter portion.

In another aspect, the variable diameter portion of the body includes an inner surface and milled product flows along the inner surface radially outward and longitudinally toward the discharge grate during discharge.

BRIEF DESCRIPTION OF THE DRAWINGS

FIG. 3 is a front sectional view of an alternative embodiment of the rotatable body having a cylindrical portion and one variable diameter portion.

FIG. 4 is a front cross-sectional side view of the rotatable body of FIG. 1 including a conveying system.

DETAILED DESCRIPTION

Figure 1:
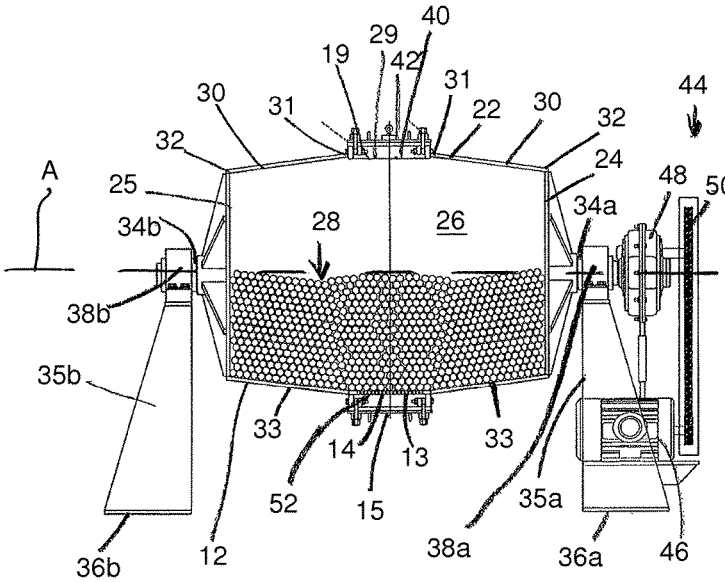
FIG. 1 is a front sectional view of a rotary milling system having a rotatable body with a cylindrical portion and two variable diameter portions.
Figure 2:
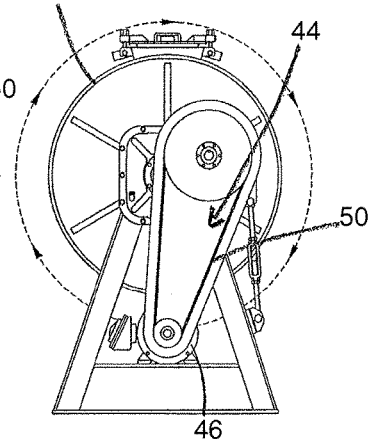
FIG. 2 is a side view of the rotary milling system.

Referring now to the drawings, FIGS. 1-13 illustrate a rotary mill system 10 for milling a desired product. As shown in FIGS. 1 and 2, the system 10 includes a rotatable body 12, in which grinding media 28 are disposed. The body includes an opening 13 in a side of the housing through which milled product can be recovered from the body 12 after the product has been sufficiently milled.

In one approach, a discharge grate 14 is disposed over the opening 13 in the side of the rotatable body 12. The discharge grate 14 can be removable in some embodiments to allow for dumping of the milled product and grinding media, if necessary. However, in a preferred form, the discharge grate 14 remains in place, in order to retain the grinding media within the body 12, and to allow the milled product to exit through the grate 14.

The system 10 can further include a discharge cover 15 that is mounted over the discharge grate 14. The discharge cover 15 can be mounted over the discharge grate 14 to block the discharge grate 14 and to limit milled product from escaping past the cover 15. The discharge cover 15 can be removable to allow the milled product to be removed from the body 12 at the completion of the milling process. The use of the fixed or removable discharge grate 14 and associated discharge cover 15 can be used in embodiments where the milled product is dumped rather than conveyed using an integrated conveying system. If milled product is conveyed rather than dumped, the discharge cover 15 will typically not be used.

In another embodiment, shown in FIG. 4, rather than using the fixed or removable discharge grate 14 along with a discharge cover 15, the system 10 includes structure for conveying the milled product from the body 12 after the milling process is complete. FIG. 4 illustrates one type of conveying system, however other conveying systems, further described below, can be used.

With reference again to FIG. 1, the body 12 includes a sidewall 22 extending between a first end wall 24 and a second end wall 25. The sidewall 22 and end walls 24 and 25 define a cavity 26 having a longitudinal central axis A. The body 12 generally includes the grinding media 28 disposed within the cavity 26 for performing a traditional rotary milling operation. The amount of grinding media 28 depends on the needs of the user. For example, the cavity 26 could be approximately 50% full of grinding media 28 by volume. Of course, other amounts, such as 30-60%, could also be used.

The grinding media 28 may be any suitably hard material, such as carbon steel, stainless steel, tungsten carbide, alumina, zirconia, porcelain, or the like. The grinding media can have different sizing as necessary. For example, in one form, the grinding media can be between ¼ inches in diameter to 1 inch in diameter. Of course, it could also be as small ⅛ inch or as large as 3 inches in diameter. The grinding media 28 is preferably a uniform size; however, the media size used in a particular operation could be different, where some of the media could be, for example, 1 inch in diameter with others being 2 inches in diameter. These sizes are merely exemplary and it will be appreciated that various other sizes of the grinding media could also be used.

With reference again to the sidewall 22, in one approach, the sidewall 22 includes a cylindrical portion 29 and at least one conical portion 30. The conical portion 30 extends away from the cylindrical portion 29 and toward at least one of the end walls 24, 25. In one approach, shown in FIG. 1, the body 12 includes two conical portions 30*a*, 30*b*, with one extending toward end wall 24, and the other extending toward end wall 25. While this approach includes two conical portions 30*a*, 30*b*, for purposes of discussion and clarity, one of the conical portions 30*a* will be described. It will be appreciated that the discussion regarding the conical portion 30*a* can also apply to the other conical portion 30*b*.

The conical portion 30*a*, while referred to a "conical" is generally not in the form of a full cone. Rather, the conical portion 30*a* has a frustoconical, tapered, sloping, or variable diameter shape. It will be appreciated that reference to the conical portion 30*a* can refer to these other shape descriptions. The conical portion 30*a* has a first diameter that generally conforms to the diameter of the cylindrical portion 29. The diameter of the conical portion 30*a* decreases as it extends away from the cylindrical portion 29 and toward the end wall 24, such that the conical portion 30 can also be referred to as a variable diameter portion.

The diameter of the conical portion 30*a* can generally decrease at a constant rate, such that it defines a generally constant slope or taper between the end wall 24 and the cylindrical portion 29. The diameter of the end wall 24 generally conforms to the diameter of the conical portion 30*a* at the interface between the conical portion 30*a* and the end wall 24. Accordingly, the diameter of the body 12 at the end wall 24 is smaller than the diameter of the body 12 at the cylindrical portion 29.

The conical portion 30*a* includes an inner end 31 and an outer end 32. The inner end 31 is disposed at the interface between the cylindrical portion 29 and the conical portion 30*a*. The outer end 32 is disposed at the interface between the conical portion 30*a* and the end wall 24.

The above description also applies to the other conical portion 30*b* extending toward the end wall 25, which in one approach, as shown in FIG. 1, has the same size and shape while extending in the opposite direction from the cylindrical portion 29.

The pair of conical portions 30*a*, 30*b*, combined with the cylindrical portion 29, therefore defines the body 12, sidewall 22, and the cavity 26 as a general barrel-shape, having a wider middle than its ends. The shape of the body 12 in this arrangement therefore defines an inner sloped surface 33 that slopes from the ends 24, 25 toward the cylindrical portion 29.

The above described opening 13 and discharge grate 14 are preferably disposed on the body 12 at the cylindrical portion 29. In one approach, the longitudinal width of the discharge grate 14 generally conforms to the width of the cylindrical portion 29, such that the conical portion 30*a* begins at the edge of the discharge grate 14. However, it will be appreciated that the cylindrical portion 29 may have a width that is wider than the discharge grate 14. In another approach, the discharge grate 14 can extend into one or more of the conical portions 30, such that the width of the discharge grate 14 exceeds the cylindrical portion 29.

The body 12 is generally arranged and supported horizontally. Accordingly, the sloped shape of the conical portions 30*a*, 30*b* will cause the grinding media 28 and milled product housed within the body 12 to be urged toward the cylindrical portion 29 due to gravity, as well as due to the centrifugal forces that occur during rotation, where the radial outward force combines with the slope of the conical portions 30*a*, 30*b* to urge the milled product toward the cylindrical portion 29 of the body 12. With the opening 13 and discharge grate 14 disposed at the cylindrical portion 29, the milled product is therefore urged toward the discharge grate 14 as a result of the sloped shape. In one approach, the slope or taper of the conical portions 30*a*, 30*b* is about 2 degrees. It has been found that a slope or taper of about 2 degrees is sufficient to generally eliminate reliance on "random walk" and enough to cause the milled particles to move in the direction toward wider diameters. Because of the sloped shape of the conical portions 30*a*, and 30*b*, gravity acting on the particles is not normal to the inner surface as it is in horizontally oriented cylinders.

With the grinding media and milled product being urged toward the discharge grate, the grinding media and milled product will migrate toward the discharge grate more easily, and will have less reliance on "random walk" to reach the discharge grate 14 relative to a cylindrical body 12. In the case of liquid milling, depending on the viscosity of the liquid, the sloped shape may assist with draining the liquid toward the discharge grate 14, or similarly reduce the reliance on "random walk" for the milled product and liquid medium to reach the discharge grate 14.

The body 12, cylindrical portion 29, and conical portions 30*a*, 30*b* have been described as creating a generally constant slope toward the cylindrical portion 29. However, it will be appreciated that the body 12 can also have a generally curved profile, such that the slope is variable and defining a generally curved shape, with the slope being different at different longitudinal locations. The conical portions 30*a*, 30*b* would therefore not be frustoconical, but would still be a variable diameter with a variable slope and a curved profile. The profile could be curved to define a concave shape within the cavity of the body, or it could have a generally complex curvature where the slope both increases and decreases along the longitudinal axis. However, for the purposes of discussion, the conical portions 30*a*, 30*b* will be described as having a generally constant slope along their lengths.

The conical portions 30*a*, 30*b* can also have different slopes, so that the slope of the conical portion 30*a* on one side of the cylindrical portion 29 is greater than the slope on the opposite side of the cylindrical portion 29. However, for purposes of discussion, the two conical portions 30*a*, 30*b* will be described as having the same shapes and resulting slopes.

The conical portions 30*a*, 30*b* can, in one approach, have the same longitudinal length as measured from their first ends 31 to their second ends 32. However, in another approach, the conical portions 30*a*, 30*b* can have different longitudinal lengths, with one conical portion 30*a* being shorter than the other conical portion 30*b*. The long and short conical portions 30*a*, 30*b* could have the same slope, or they could have different slopes.

The conical portions 30*a*, 30*b* can, in one approach, have the same diameter at their respective second ends 32.

However, in another approach, the conical portions 30*a*, 30*b* can have different diameters at their respective second ends 32.

The degree of the slope or angle of the conical portions 30*a*, 30*b* is preferably selected such that the change in linear velocity along the sidewall 22 near the end walls 24, 25 does not differ too much relative to the linear velocity near the cylindrical portion 29. Because the body 12 is rotated at a selected speed, the resulting linear velocity at the sidewall 22 near the cylindrical portion 29 having a larger diameter is greater than the linear velocity at the sidewall 22 near the end walls 24, 25, which have a smaller diameter. These velocities near the sidewall 22 can be referred to as the "critical speed." The angle or slope of the conical portions 30*a*, 30*b* is preferably selected such that the difference in critical speed at the cylindrical portion 29 relative the end walls 24, 25 is between about 1% and 10%, in order to limit the effect on milling dynamics. In one approach, the angle or slope of the conical portions 30*a*, 30*b* is about 2 degrees. This approach has only a nominal effect on the critical speed, but is enough to eliminate the need for "random walk" and to move particles in the direction of the wider portions of the conical portions 30*a*, 30*b*.

Figure 5A:
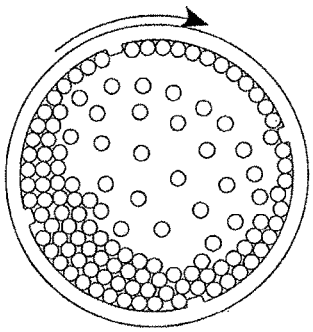
FIGS. 5A-5C is illustrate grinding media contained within the rotatable body and rotating at different critical speeds.
Figure 5B:
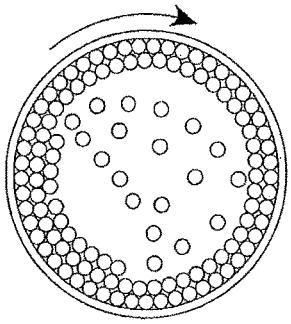
Figure 5C:
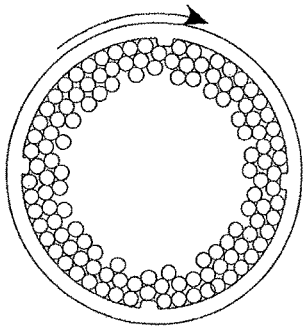

An illustration of the grinding media 28 being rotated at different critical speeds is shown in FIGS. 5A-5C. Rotary ball mills typically operate at a percentage of their critical speed, which generally depends on three variables: the diameter of the milling body or cylinder, the rotational speed of the body or cylinder, and to a lesser extent the diameter of the grinding media 28. The critical speed is the speed described in revolution per minute at which the first layer of grinding media 28 will centrifuge against the sidewall of the mill body 12 or cylinder, rendering the grinding media relatively motionless relative to the rotating body (FIG. 5A). This condition is typically referred to as the first critical speed and acts as the basis for determining operational mill speeds. The second critical speed occurs where two layers of grinding media are rendered motionless relative to the rotating body (FIG. 5B). When the mill body or cylinder speed is sufficiently fast to centrifuge all of the grinding media to the sidewall, no movement of the grinding media 28 relative to the body 12 or cylinder is taking place, and therefore no grinding is taking place (FIG. 5C). This condition is typically referred to as the Nth critical speed. In order for grinding media to move in a cascading and tumbling action inside the mill body or cylinder, mills generally operate at between 50-70% of the first critical speed, although speeds as low as 20% of the critical speed and as high as 90% of the critical speed are also possible.

Critical speed can be expressed via the following formula: $CS=1/2\pi\sqrt{(g/(R-r)}$, where CS is Critical Speed, g is a gravitational constant, R is the radius of the mill, and r is the radius of one piece of grinding media.

Because the ends of the body 12 are smaller in diameter than at the cylindrical portion 29, the critical speed is higher, because the smaller diameter requires a faster rotational speed to achieve the same centrifuging of the first layer of grinding media 29. Accordingly, grinding media will tumble less energetically at the ends of the body 12 than at the cylindrical portion 29.

Accordingly, it is preferable for the diameters of the cylindrical portion 29 and the ends 24 and 25 to remain dimensionally close, yet with a difference that is large enough to create enough of a slope to allow milled product to sufficiently flow toward the discharge grate 14. In one approach, the slope or taper of the conical portions 30*a*, 30*b* is about 2 degrees.

By way of example, the change in critical speed for different tapers will now be discussed. A rotary mill body with a 72 inch diameter in the center and 1 inch diameter grinding media has a critical speed of approximately 31.5 rpm. For a taper 1 degree from horizontal, the critical speed at the end 32 of the mill is about 31.8 rpm (where the end 32 has a diameter of about 70.62 inches). For a taper 2 degrees from horizontal, the critical speed is about 32.1 rpm (where the end 32 has a diameter of about 69.23 inches). For a taper 3 degrees from horizontal, the critical speed is about 32.5 rpm (where the end 32 has a diameter of about 67.84 inches). For a taper 4 degrees from horizontal, the critical speed is about 32.8 rpm (where the end 32 has a diameter of about 66.45 inches). For a taper 5 degrees from horizontal, the critical speed is about 33.2 rpm (where the end 32 has a diameter of about 65.06 inches). For a taper 6 degrees from horizontal, the critical speed is about 33.5 rpm (where the end 32 has a diameter of about 63.66 inches). For a taper 7 degrees from horizontal, the critical speed is about 33.9 rpm (where the end 32 has a diameter of about 62.26 inches). For a taper 8 degrees from horizontal, the critical speed is about 34.3 rpm (where the end 32 has a diameter of about 60.85 inches). Thus, even at an 8 degree taper from horizontal, the difference in critical speed is about 8.9% relative to no taper.

By way of further example, with reference to a 2 degree taper, if the body 12 is operated at about 60% of critical speed at the cylindrical portion of the mill (72 inch diameter), this would be about 18.9 rpm. With a 2 degree taper, the reduced diameter end 32 of the body 12 would be about 69.23 inches. To match the performance at the end 32 to the performance of the cylindrical portion 29, the body 12 would need to rotate at 19.28 rpm. However, the cylindrical portion 29 and the end 32 will have the same rpm during rotation. Thus, the end 32 will rotate at 18.9 rpm if the rotation speed of the body 12 is set according to 60% of the critical speed of the cylindrical portion 29. Thus, the percentage difference of 18.9 actual rotational speed to 19.28 rpm "desired" speed is about 2%, so the ends 32 are rotating at about 2% below the "desired" speed. It will be appreciated that "desired" refers to the speed where the performance at the end 32 would match the performance at the cylindrical portion 29 and that operating at the same rotational speed as the cylindrical portion is not undesirable.

Other differences relative to 18.9 rpm for different tapers to match the performance of 18.9 rpm are as follows: 1 degree, 19.09 rpm; 3 degrees, 19.48 rpm; 4 degrees, 19.69 rpm; 5 degrees, 19.90 rpm; 6 degrees, 20.12 rpm; 7 degrees, 20.35 rpm; and 8 degrees, 20.59 rpm.

Generally, it is preferable to operate a mill within 5% of its expected speed due to outside factors affecting the actual rpm. Thus, the difference of 2% of a 2 degree taper is within that range. Accordingly, the taper of the conical portions 30*a*, 30*b* is preferably in the range of 1-5 degrees. However, tapers outside this range could also be used if desired by the user.

The tapers illustrated in the Figures are for illustrative purposes and may be exaggerated relative to the tapers used in practice. The purpose of the illustrated taper is to clarify that the body 12 is not cylindrical and includes the conical portion 30*a* or portions 30*a*, 30*b* having ends with diameters that are smaller than the cylindrical portion 29.

The system 10 has been described as having a pair of conical portions 30*a*, 30*b* with one extending to one side from the cylindrical portion 29 and the other extending to the opposite side of the cylindrical portion 29.

In an alternative approach, and with reference to FIG. 3, a single conical portion 30*a* can be used in addition to the cylindrical portion 29. In this approach, the conical portion 30*a* extends toward end wall 24 shown in FIG. 3. The body 12 also includes an end wall 25*b*. The diameter of body 12 at the end wall 25 is smaller than the diameter of the cylindrical portion 29, resulting in a similar sloped arrangement of the conical portion 30*a* relative to the cylindrical portion 29. The discharge grate 14 is similarly located on the cylindrical portion 29. Accordingly, grinding media and milled product will be urged toward the cylindrical portion 29 and the discharge grate 14, similar to the above described embodiment having the two conical portions 30*a*, 30*b*.

Unlike the previously described embodiment, the diameter of the end wall 25*b* generally conforms to the diameter of the cylindrical portion 29 of the body 12. The cylindrical portion 29 is also no longer disposed near the middle of the body 12. Rather, the cylindrical portion 29 and discharge grate 14 disposed on the cylindrical portion 29 are located generally at one end of the body 12 and adjacent the end wall 25*b*. Accordingly, milled product generally flows in one direction, from end wall 24 toward the discharge grate 14 disposed near the opposite end of the body, rather than toward the middle of the body 12 from opposite ends of the body 12.

The inner end 31 of the conical portion 30*a* is disposed at the cylindrical portion 29, and the outer end 32 is disposed near the end wall 24.

This embodiment with the one conical portion 30*a* can be referred to as the single-cone embodiment, with the previously described embodiment with the two conical portions 30*a*, 30*b* as the double-cone embodiment.

The single-cone embodiment may be desirable to account for different plant layouts, discharge locations, quantity of product to be milled, or other requirements of the milling process. The single-cone embodiment also provides different considerations of critical speed difference and degree of slope.

The above described variations to the shape of the conical portions 30*a*, 30*b* with reference to the double-cone embodiment apply equally to the single-cone embodiment, such as constant slope, variable slope, curved shapes, etc.

In both embodiments, the discharge grate 14 and opening 13 are disposed further away from the longitudinal axis A than the outer end 32 of the conical portion, such that the slope will assist in urging milled product toward the discharge grate 14 due to gravity and centrifugal forces. The milled product therefore moves both longitudinally as well as radially outward during discharge.

Accordingly, when the body 12 is stationary and oriented such that discharge grate 14 is at the bottom, the discharge grate is positioned below the peripheral edge of the outer end 32 of the conical portion 30*a* and the perimeter of the end wall 24.

The double-cone and single-cone embodiments of the body 12 can be used for both dry milling, where only the solid product to milled is included in the cavity 26 with the grinding media 28, or wet milling, where liquid medium is included with the product to be milled within the cavity.

Both the double-cone or single-cone embodiments can also be used with full size discharge housings that surround the entire body 12 and include a hopper at the bottom to retrieve the milled product, where the body 12 rotates within the full size discharge housing. Both embodiments can also be evacuated by dumping or conveying.

Having described the body 12 and its double-cone and single-cone arrangements, the associated structure for rotating and supporting the body 12 and discharging the milled product will now be described in further detail.

With reference again to FIG. 1, the body 12 also includes a first trunion 34*a* and a second trunion 34*b* extending outwardly from the end walls 24 and 25, respectively, along the axis A. The trunions 34*a*, 34*b* support the body 12 for rotating. More specifically, the system 10 includes a pair of vertical support members 35*a*, 35*b* each having a base 36*a*, 36*b* for contacting a support surface such as a floor and a bearing 38*a*, 38*b* for engaging and supporting the trunions 34*a*, 34*b* for rotation therein.

The body 12 further includes a loading opening 40 extending through the sidewall 22 for delivering grinding media 28 or the product to be milled. An access hatch or loading cover 42 can be mounted over the opening 40 for sealing the opening 40 in a manner known in the art. The loading opening 40 can be diametrically opposed from the discharge grate 14 on the opposite side of the body 12. However, other locations of the loading opening 40 in the sidewall 22 could be used.

Turning to FIGS. 1 and 2, the system 10 includes a transmission portion 44, including a motor 46, gear reducer 48, and belt 50. The gear reducer 48 is operatively coupled to the first trunion 34*a*. The transmission portion 44 can generally operate and be controlled in a manner known in the art to rotationally drive the body 12 through the connection between the gear reducer 48 and the first trunion 34*a*.

Referring back FIG. 1, the discharge grate 14 is provided on the sidewall 22 of the body 12. The discharge grate 14 is configured with openings 52 that are sized to retain the grinding media 28 within the cavity 26, while allowing the milled product to pass through the openings 52. In one form, the openings 52 can be in the form of slots approximately 0.25 inches wide. However, it will be appreciated that other opening sizes could be used to retain the grinding media 28 while allowing the product to pass. The openings 52 can be seen in further detail in FIGS. 6 and 9.

Figure 6:
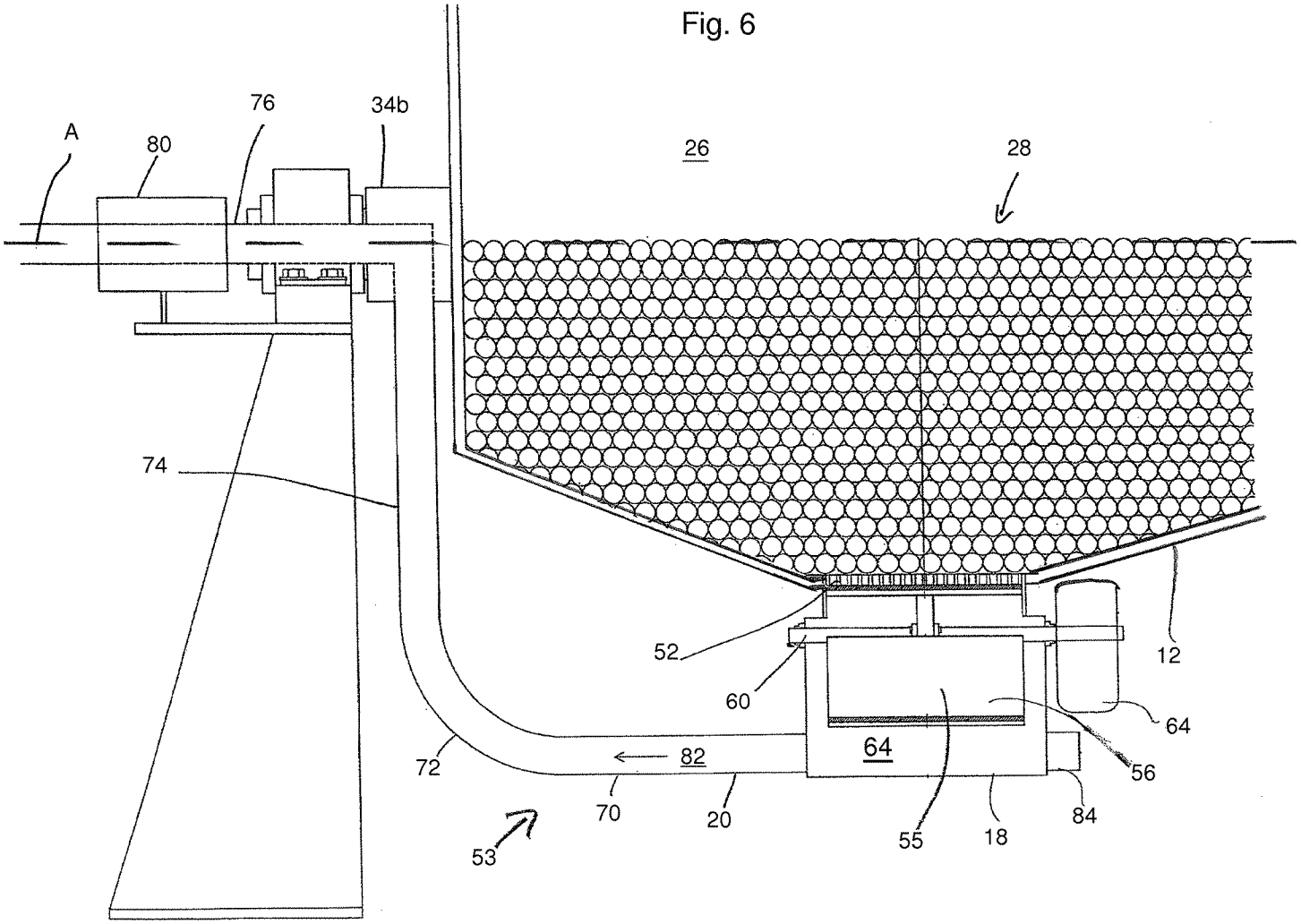
FIG. 6 is a partial cross-sectional side view illustrating a portion of the conveying system of FIG. 4.

As described above, in some embodiments, the system 10 can include structure for conveying milled product from the body 12. FIG. 4 illustrates one embodiment of a conveying system 53 that can be used for conveying both dry milled product as well as milled product from the body 12. FIG. 4 shows the conveying system 53 being used with the double-cone embodiment, but it will be appreciated that the system 53 can be used with the single-cone embodiment as well. FIG. 6 illustrates the conveying system 53 in more detail.

With reference to FIGS. 4 and 6, a discharge housing 18 surrounds the discharge grate 14 to create an airtight or liquid-tight seal between the housing 18 and the body 12. Accordingly, the housing 18 may be attached to the sidewall 22 of the body 12 to surround the discharge grate 14. The seal between the housing 18 and the body 12 helps to limit milled product from escaping to the adjacent area or onto the outer surface of the body 12 outside the housing 18. Thus, the body 12 and the surrounding environment may be kept cleaner relative to a housing surrounding the entire body 12. A cavity 54 is defined by the space between the housing 18 and the body 12 into which milled product and liquid can be temporarily stored after passing through the openings 52 in the grate 14.

A conveying pipe 20 extends from the housing 18 for conveying milled product away from the discharge housing 18 for further processing and retrieval. In one approach, the conveying pipe 20 can transport dry milled product or milled product suspended in liquid medium.

The product to be milled or milled product can be limited from entering the conveying pipe 20 by including a valve 55 disposed in the flow path between the cavity and the conveying pipe 20. The valve 55 can be in the form of a pivotable flap 56 that can selectively cover and uncover the discharge grate 14 to prevent milled product from passing through the discharge grate 14 or allow milled product to pass through the discharge grate 14 for subsequent conveying through the conveying pipe 20. The flap 56 can be used for both dry discharge and wet discharge.

Alternatively, in the case of wet milling operations having milled product suspended in a liquid medium, the valve 55 can be in the form of a liquid-tight valve 160, further discussed below with reference to FIG. 9.

When the valve 55 is in the form of the flap 56, the flap 56 is preferably disposed within the housing 18 and sized and shaped to cover the discharge grate 14. The flap 56 is pivotable away from the discharge grate 14 to allow for milled product to flow therethrough and into the cavity 54 of the housing 18.

When the valve 55 is in the form of a liquid tight valve 160, the valve 55 can be positioned away from the discharge grate 14 and at a location near the interface between the conveying pipe 20 and the housing 18. The liquid tight valve 160 can be disposed away from the discharge grate because during a liquid milling process liquid medium may pass back and forth through the discharge grate 14 during the milling process.

The housing 18, the conveying pipe 20, and the associated intermediate structure including the valve 55 will rotate along with the body 12 during the milling process. Similarly, the housing 18, conveying pipe 20, and associate structure will rotate with the body 12 during the discharge process when the discharge process uses rotation. Thus, the discharge housing 18, conveying pipe 20, and body 12 will rotate together.

Having described the general structure of the discharge housing 18 and conveying pipe 20, the specific structure of different conveying mechanisms will now be described in further detail.

With reference again to conveying system 53 illustrated in FIGS. 4 and 6, the housing 18 can further include first and second access hatches 57 and 58 that can provide access into the housing cavity 54, if necessary. The access hatches 57 and 58 can be gasketed and bolted in a manner known in the art to provide a dust-tight and liquid-tight seal between the housing cavity 54 and the air surrounding the housing 18.

Figure 7:
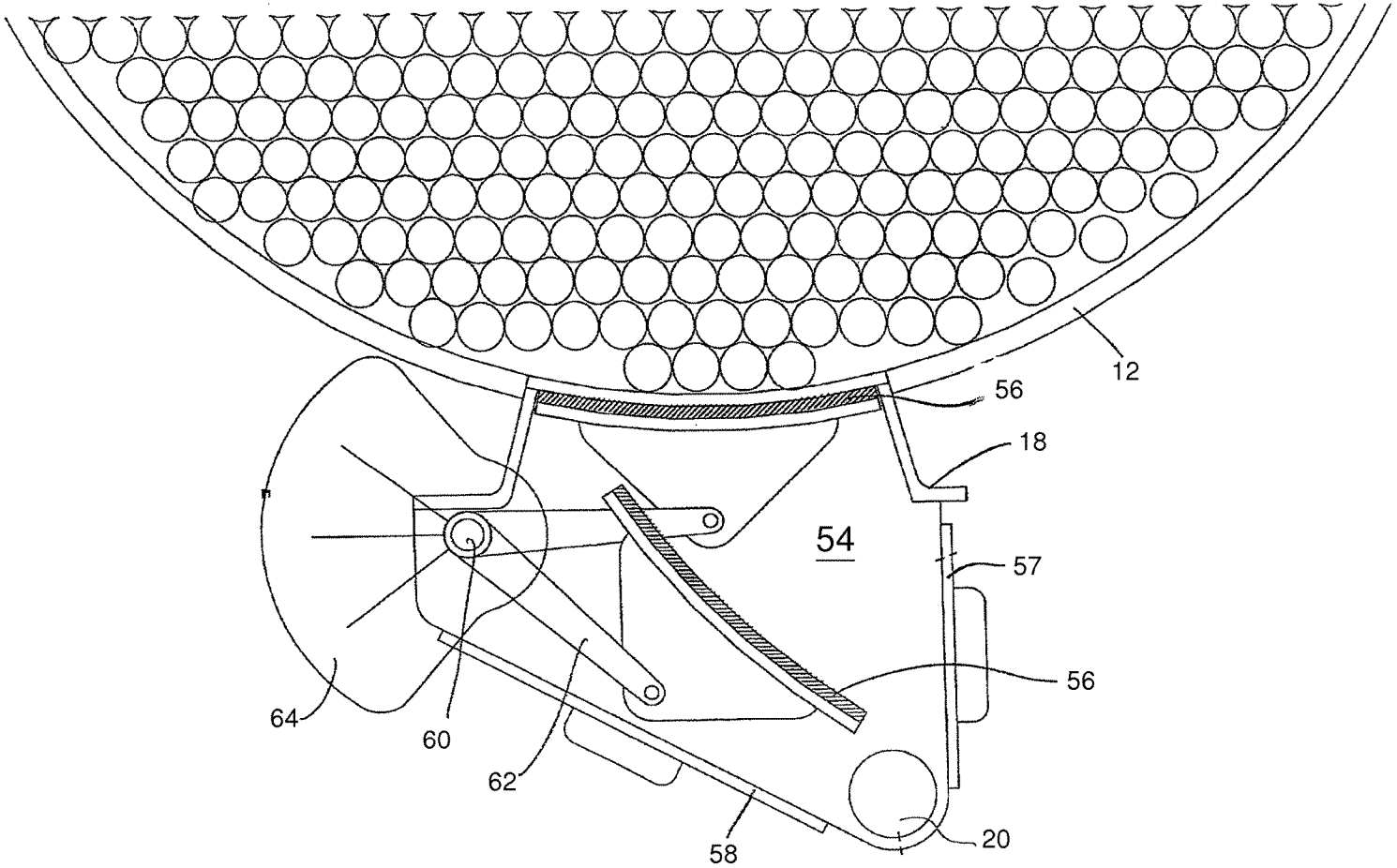
FIG. 7 is a side cross-sectional view of a portion of the conveying system of FIG. 4.

With reference to FIGS. 6 and 7, the flap 56 is disposed within the housing cavity 54 and is sized to correspond to the size of the discharge grate 14. The flap 56 is pivotable into and out of contact with the discharge grate 14 to prevent and allow discharge of product through grate 14, respectively. FIG. 4 shows the flap 56 in both the open and closed positions. The flap 56 can have a generally curved profile to correspond to the curved shape of the body 12, and can be pivotable about an axle 60 via a linkage 62. The flap 56 can have an elastomer face or other material that can provide a seal between the grate 14 and the flap 56 when the flap 56 is in the closed position.

An actuator 64 can be connected to the axle 60 outside of the housing 18 to rotate the axle 60 and thus, pivot the flap 56. The actuator 64 can be manually operated to open and close the flap 56 or it could be automatically operated. In the case of manual operation, an operator can be positioned adjacent the housing 18 with limited interaction with the dust produced by the milled solid. In the case of automated operation, the operator can be positioned remotely to open and the close the flap 56 likewise limiting interaction with the milled product. In one form, the actuator 64 can be in the form of a vane actuator, as shown in FIG. 6.

An automated actuator 64 can be activated in a manner known in the art. For example, the actuator 64 can be pneumatically actuated. The pneumatic pressure can be provided by a supply line 66 (shown in FIG. 4) extending radially from the first trunion 34*a*, as well as longitudinally through the first trunion 34*a* to an air supply source (not shown).

With reference to FIGS. 4 and 6, the milled product can be delivered from the housing 18 via the conveying pipe 20. The conveying pipe 20 is in fluid communication with the housing 18. For example, the conveying pipe 20 can be mounted or connected to the housing 18 away from the discharge grate 14 and the body 12. The conveying pipe 20 has a generally circular cross-section and includes a longitudinal portion 70 extending generally parallel to the longitudinal axis A of the body 12. The conveying pipe 20 further includes a curved elbow portion 72 extending from the longitudinal portion 70 and transitioning into a radial portion 74, which extends toward the central axis of the body 12. The radial portion 74 is coupled with the second trunion 32 at a point generally along the central axis A of the body 12. The radial portion 74 of the pipe 20 transitions into an axial portion 76 that extends along the central axis A of the body 12 and into a rotary union 80. As a whole, the pipe 20 defines a passageway 82 having a central axis and extending through the pipe 20. The passageway 82 is in fluid communication with the housing cavity 54, so that milled product can be conveyed from the housing 18 through the pipe 20.

The housing 18 can include a check valve 84 mounted to the side of the housing 18 generally opposite the interface between the housing 18 and the pipe 20. The check valve 84 can be in the form of a poppet valve, and can operate as a vacuum breaker or to allow air into the cavity 54 to provide for sufficient conveying velocity of the milled product out of the housing 18 through the pipe 20. The check valve 20 can be configured and sized to allow for different desired air pressure within the cavity 52 in a manner known in the art.

The above described structure of the housing 18 and conveying pipe 20 can be used for both dry milling and wet milling.

With reference again to FIG. 4, the system 10 further includes a secondary pipe 86 extending axially from the rotary union 80 and into a separator tank 88. The secondary pipe 86 is fluidly coupled to the axial portion 76 of the conveying pipe 20 via the rotary union 80 in a manner known in the art. The separator tank 88 defines a cavity 90 for receiving milled product that has been conveyed form the conveying pipe 20 and through the secondary pipe 86. The separator tank 88 can be connected to a blower or vacuum 91. FIG. 4 illustrates that the blower or vacuum 91 is connected at the top of the tank 88. The blower or vacuum 91 can provide a negative pressure to the tank 88 as well as the secondary pipe 86 and conveying pipe 20 for drawing the milled product toward the tank 88.

The tank 88 can include different components depending on whether the milled product is a solid discharge, such as dry fine particles, or liquid discharge, where the particles are suspended in the liquid.

With reference to FIG. 4, in the case of solid discharge, the separator tank 88 can include a dust filter 92 mounted within the cavity 90 and surrounding the blower 91. The dust filter 92 can allow airflow through the filter 92 while limiting the solid discharge from being sucked into the vacuum 91. An opening can be provided at the bottom of the tank for retrieving the milled material. A valve, such as a rotary valve or slide gate valve 94 can be associated with the opening.

Figure 8:
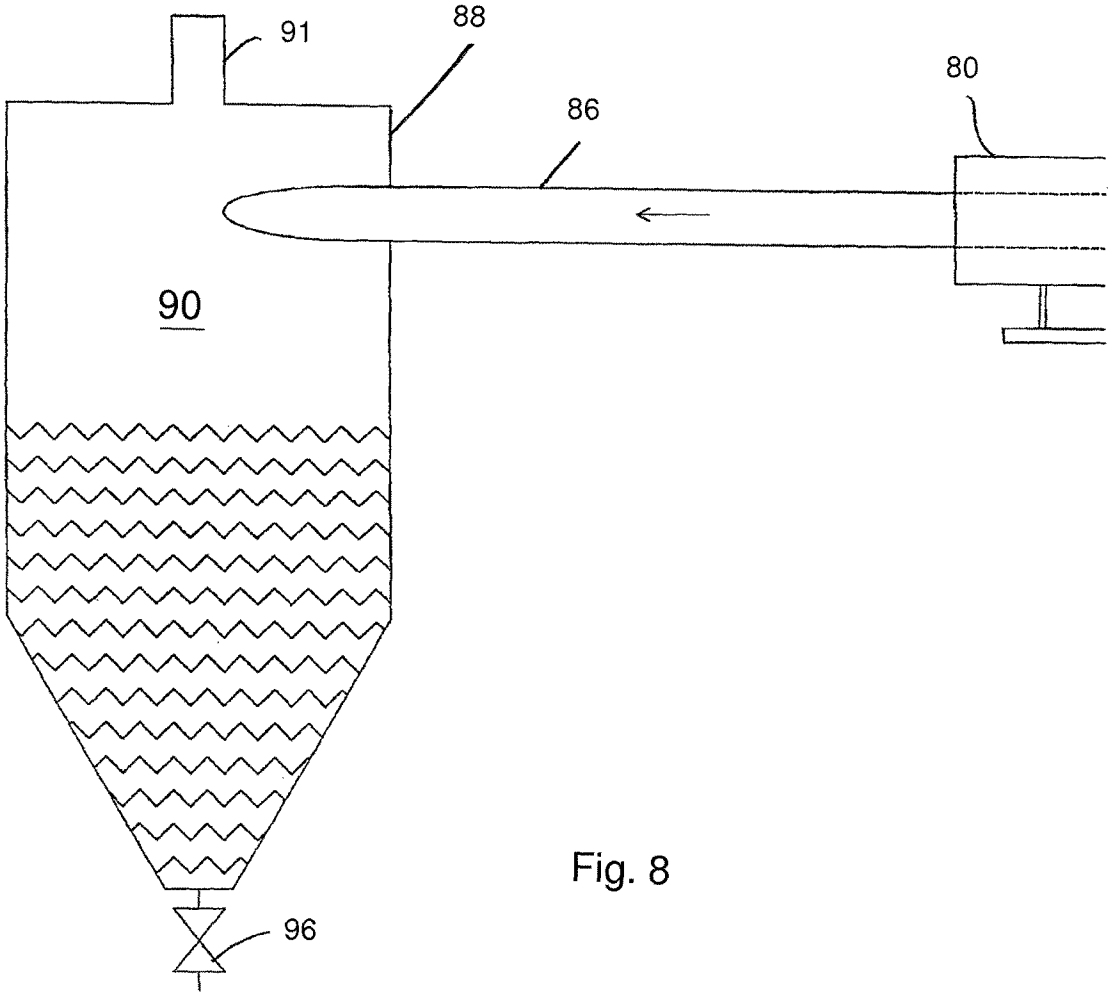
FIG. 8 is a partial view of the conveying system of FIG. 4.

With reference to FIG. 8, in the case of liquid discharge, the separator tank 88 can include a valve 96 mounted at the bottom of the tank 88. The separator tank 88 can be a cyclone separator, which can separate the milled product from the liquid. The milled product can be vacuumed out of the tank 88 through the blower or vacuum 91 mounted at the top of the tank 88, and the valve 96 can release the liquid from the tank 88.

As shown in FIG. 4, the body 12, secondary pipe 86, rotary union 80, and the axial portion 76 of the conveying pipe 20 can be coaxially aligned along the central axis A of the body 12. As the body 12 rotates about its central axis A, the coaxially aligned components, not including the secondary pipe 86 and rotary union 80, will rotate as well. The housing 18, mounted to the body 12, will rotate along with the body 12. The remaining portions of the conveying pipe 20 will rotate with the body 12 and remain connected to the housing 18. The housing 18 and tank 88 can remain fluidly connected through the pipes 20 and 86 while rotating. Thus, the milled product can be delivered to the tank 88 if the body 12 is either rotating or stationary via the conveying system 53.

The above described conveying system 53 for use with the body 12 can be used for both dry milling and wet milling. However, an alternative embodiment intended for liquid milling is further described below.

Figure 9:
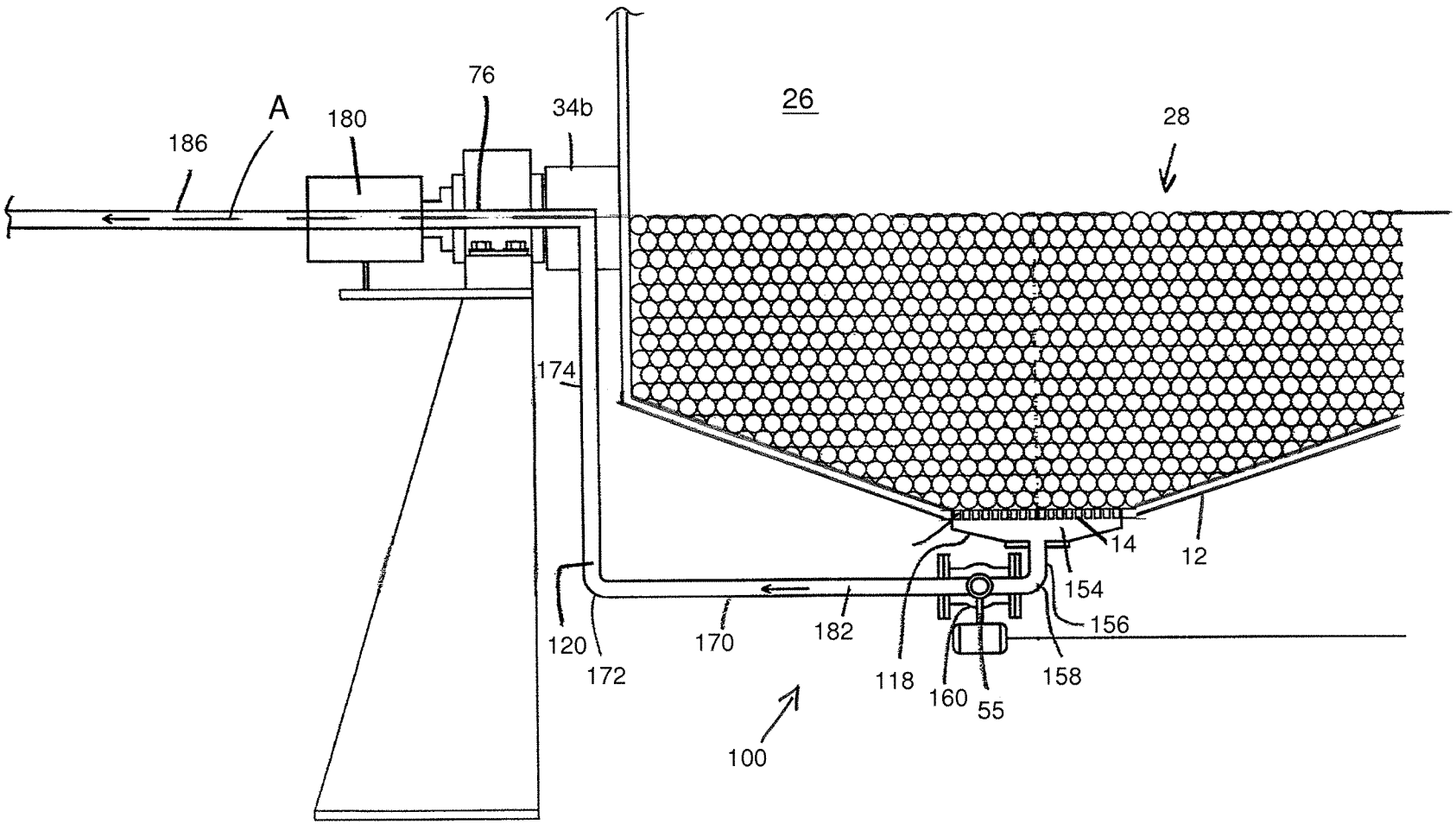
FIG. 9 is a partial view of a second conveying system for use with the rotatable body of FIG. 1.

With reference to FIG. 9, an alternative conveying system 100 can be attached to the body 12 over the discharge grate 14. The system 100 includes a housing 118 that includes an outlet pipe 156 extending outward from and generally perpendicular to the grate 14. The outlet pipe 156 is liquid-tight with the housing cavity 154 and open to the housing cavity 154. Liquid medium and milled product within the cavity 154 will therefore flow into outlet pipe 156 without leaking into surrounding areas.

The outlet pipe 156 includes a bend 158 of approximately 90 degrees such that the outlet pipe 56 extends generally parallel to the axis A.

The grate 14 remains open to the cavity 154 of the housing 118 during milling, such that the product and liquid medium within the body 12 will be able to flow through the grate 14 in both directions during milling. However, the liquid medium and product will be prevented from flowing beyond the housing 118 and pipe 156 during the milling process as further described below.

With reference to FIG. 9, the system 100 further includes a liquid-tight valve 160 attached to the outlet pipe 156 after the bend 158. The valve 160 could be a ball valve, a pinch-type valve, or a gate-type valve. The valve 160 is moveable between an open and closed position. In the closed position, the liquid medium and product will be retained within the housing cavity 154, pipe 156, and body 12. The valve 160 remains closed during the milling process, such that the medium and product can flow back into the body 12 as it is rotated for additional milling. Accordingly, the milled product and liquid medium that flows into the housing 118 isn't trapped in the housing and prevented from additional milling, even though it may flow past the grate 14 multiple times during milling. The valve 160 ensures that milled product and liquid medium will not progress further into the system until such time as discharge is desired. The valve 160 is positioned between the outlet pipe 156 and conveying pipe 120, such that when the valve is opened, liquid medium and milled product will flow through the outlet pipe 156 and into the conveying pipe 120 for further processing.

When discharge is desired, the valve 160 is opened, allowing the milled product and liquid medium to travel out of the housing 118 and body 12 through the outlet pipe 156 and past the valve 160. The valve 160 can be manually actuated to move it between the open and closed positions. Alternatively, the valve 160 can be automatically actuated.

In the case of manual operation, an operator can be positioned adjacent the housing 118 with limited interaction with the liquid medium and milled product. In the case of automated operation, the operator can be positioned remotely to open and the close the valve 160 likewise limiting interaction with the liquid medium and milled product.

An automated valve 160 can be activated in a manner known in the art. For example, the valve 160 can be pneumatically actuated. The pneumatic pressure can be provided by a supply line (not shown) similar to supply line 66 of the above described conveying system 53.

With reference to FIG. 9, the liquid medium and milled product can be delivered for further processing from the housing 118 through the outlet pipe 156 and past the valve 160 via the conveying pipe 120. The conveying pipe 120 is therefore in fluid communication with the housing 118 when the valve 160 is open. For example, the conveying pipe 20 is mounted or connected to the valve 160 at a location away from the discharge grate 14 and the body 12.

The structure of the conveying pipe 120 and additional downstream structure is similar to conveying pipe 20 and its associated structure described above with reference to conveying system 53.

The conveying pipe 120 has a generally circular cross-section and includes a longitudinal portion 170 extending generally parallel to the central axis A of the body 12. The conveying pipe 120 further includes a curved elbow portion 172 extending from the longitudinal portion 170 and transitioning into a radial portion 174, which extends toward the central axis of the body 12. The radial portion 174 is coupled with the second trunion **34*b* at a point generally along the central axis A of the body 12. The radial portion 174 of the pipe 120 transitions into an axial portion 176 that extends along the central axis A of the body 12 and into a rotary union 180. As a whole, the pipe 120 defines a passageway 182 having a central axis and extending through the pipe 120. The passageway 182 is in fluid communication with the housing cavity 154 when the valve 160 is open, so that liquid medium and milled product can be conveyed from the housing 118 through the pipe 120**.

Because the housing 118 remains open to the body 12 during milling and discharge, the pressure within the housing 118 and body 12 is generally the same. The housing 118 does not therefore require individual pressure control and does not require the use of an additional check valve or bleed valve to maintain a desired pressure within the cavity 154 or to operate as a vacuum breaker. Vacuum prevention in the body 12 and housing 118 can be accomplished by way of a vent line (not shown) extending through the trunion **34*a* and into the body 12**.

Figure 10:
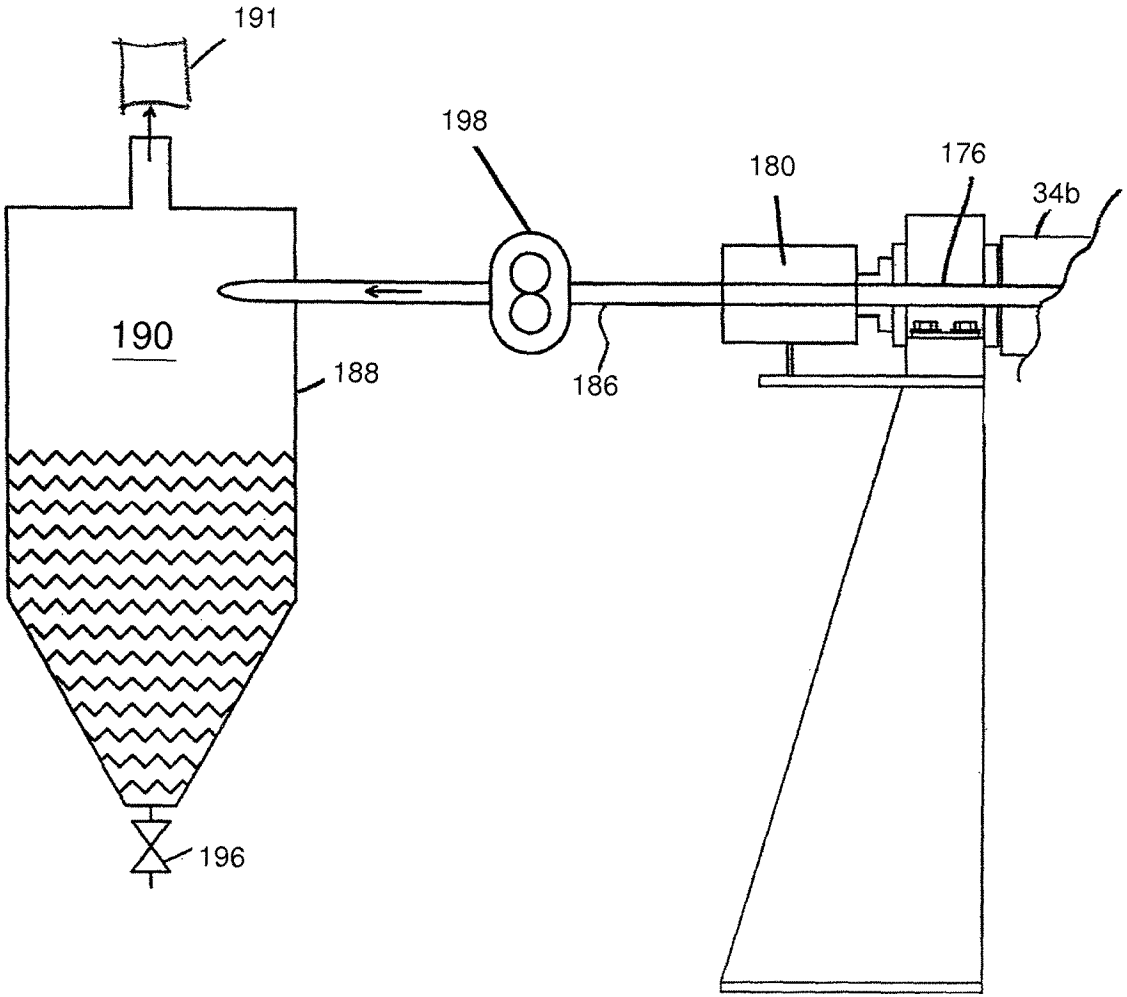
FIG. 10 is a partial view of the second conveying system.

With reference to FIGS. 9 and 10, the system 10 further includes a secondary pipe 186 extending axially from the rotary union 180 and into a separator tank 188. The separator tank 88 is in the form of a liquid-air separator tank. The secondary pipe 186 is fluidly coupled to the axial portion 176 of the conveying pipe 120 via the rotary union 180 in a manner known in the art. The separator tank 188 defines a cavity 190 for receiving liquid medium and milled product that has been conveyed form the conveying pipe 120 and through the secondary pipe 186. The separator tank 188 can be connected to a blower or vacuum 191. FIG. 9 illustrates that the blower or vacuum 191 is connected at the top of the tank 188. The blower or vacuum 191 can provide a negative pressure to the tank 188 as well as the secondary pipe 186 and conveying pipe 120 for drawing the milled product toward the tank 188.

For the liquid discharge of liquid medium and milled product, the separator tank 188 includes a valve 196 mounted at the bottom of the tank 188. The separator tank 188 can be a cyclone separator that can separate the milled product from the liquid. The milled product can be vacuumed out of the tank 188 through the blower or vacuum 191 mounted at the top of the tank 188, and the valve 196 will release the liquid from the tank 188.

In an another approach, and with reference to FIG. 9, the system 10 can include a pump 198 mounted in-line with the stationary secondary pipe 186 between the separator tank 188 and the rotary union 180. The pump 198 can be in the form of a positive displacement or centrifugal pump, or any pump with an eccentric screw, rotary, diaphragm, lobe, or the like. This type of pump 198 is beneficial for liquid discharge because it can provide an alternative method for discharging the milled product by pumping the liquid medium in which the milled product is suspended. This is generally not available for discharging dry milled product.

Accordingly, the use of the pump 198 makes the vacuum 191 attached to the top of the separator tank 188 redundant. Thus, when the pump 198 is used, it can be used without the vacuum 191. However, if desired, the vacuum 191 and pump 198 could be used together. If no vacuum is mounted to the top of the tank 188, the top of tank 188 will vent.

FIG. 9 illustrates both the vacuum 191 and pump 198, but it will be appreciated that the system 100 may only include one of the vacuum 191 and pump 198.

With reference again to FIG. 9, the housing 118 and conveying pipe 120, will rotate along with the body 12, similar to the conveying system 53. The outlet pipe 156 and valve 160 will likewise rotate along with the body 12. The remaining portions of the conveying pipe 120 will rotate with the body 12 and remain connected via the valve 160 and outlet pipe 156 to the housing 118. The housing 118 and separator tank 188 can remain fluidly connected when the valve 160 is open through the pipes 120 and 186 while rotating. Thus, the milled product can be delivered to the tank 188 if the body 12 is either rotating or stationary.

Having described the general structure of the system 10, the function of the rotary milling systems 10 described above will now be described in further detail. The milling process is typically the same for both conveying systems 53 and 100. However, the conveying process is slightly different and will be described as necessary.

With the body 12 in a stationary position and the flap 56 or valve 160 in the closed position, the loading cover 42 can be opened to allow access into the cavity 26 of the body 12. The desired product to be milled can be deposited into the cavity 26 for subsequent milling by the system 10. This process can be performed for both dry milling and liquid milling. In the case of liquid milling, liquid medium can also be deposited. Additionally, grinding media 28 can be deposited into the cavity 26 or removed from the cavity 26 depending on the needs of the user.

The liquid medium can be any suitable and known medium used for wet milling. For example, without intending to limit the liquid medium, the liquid medium can include water, solvents, emulsifiers, surfactants, alcohols, ethers, and other organic liquids as well as mixtures. The liquid medium can have a viscosity depending on the needs and desires of the user for the milling procedure. In one approach, the liquid medium can be a low viscosity Newtonian liquid. In another approach, the liquid medium can be a high-viscosity thixotropic or shear-thinning liquid. The type of liquid medium used will affect the manner of discharging the liquid medium and milled product at the conclusion of the milling process, which will be further described below.

Once the desired amount of product to be milled and grinding media 28 are present in the cavity 26 of the body 12, the loading cover 42 can be replaced on the body 12 to create a seal and limit milled product from exiting the cavity 26 during the milling process. Similarly, the flap 56 or valve 160 is in the closed position in a sealed configuration to likewise limit milled product from being conveyed during the milling process.

Figure 11B:
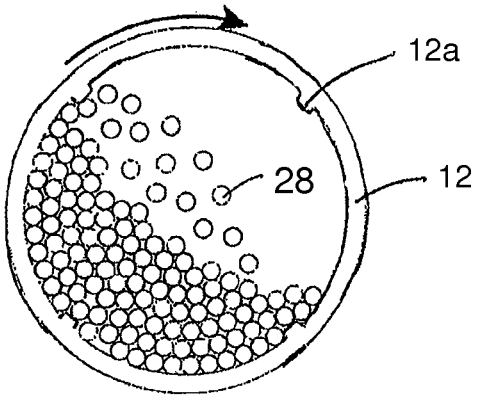
FIG. 11B is a cross-sectional view of the rotatable body showing the body in a rotating configuration and cataracting grinding media therein.
Figure 11A:
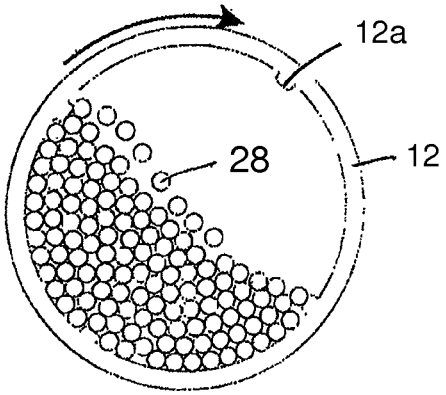
FIG. 11A is a cross-sectional view of the rotatable body showing the body in a rotating configuration and tumbling grinding media therein.

With reference to FIGS. 11A and 11B, with the product ready for milling, the body 12 can be controllably rotated by the transmission portion 44 of the system 10 in a manner known in the art. The body 12 will rotate about its central axis A via the interface between the trunions 34*a*, 34*b* and the bearings 38*a*, 38*b*. As the body 12 rotates, the grinding media 28 is lifted and then tumbles back down to the bottom of the body 12. This tumbling causes the grinding media 28 to abrade and impact the solid product. There are two types of action for the grinding media depending on the speed of rotation of the body 12. "Tumbling" occurs at lower rotational speeds, with the grinding media 28 rolling or tumbling across the build-up of media 28 in the lower portion of the body 12 and is illustrated in FIG. 11A. "Cataracting" occurs at higher rotational speeds, where the media 28 free-falls from the top of the body 12 to the mass of media 28 at the bottom of the body 12 and is illustrated in FIG. 11B.

To assist in lifting the grinding media during operation, the body 12 can include a plurality of longitudinally running ribs 12*a* within the cavity 26 of the body 12. These ribs 12*a* can be seen in FIGS. 11A and 11B.

As stated above, the solid product to be milled can be processed in a dry milling operation or a wet milling operation. In the dry milling operation, the solids are milled in a dry state and subsequently discharged dry. In the wet milling operations, the solids are milled in a liquid medium and the milled product is discharged as a liquid suspension or dispersion. Both processes are performed in the same general manner described above, with the body 12 rotating at a selected speed to cause the grinding media 28 to be lifted and then fall or tumble to abrade the product.

During the rotation of the body 12, the housing 18, 118 and conveying pipe 20, 120 will rotate about the longitudinal axis A of the body 12. Because the conveying pipe 20, 120 extends to couple with the trunion 34*b* and into the rotary union 80, the pipe 20, 120 remains in fluid communication with the housing 18, 118 mounted to the body 12 and the secondary pipe 86, 186 leading to the separator tank 88, 188.

During rotation of the body 12 during the milling process, the different portions of the body 12 will rotate at different linear velocities at the perimeter of the body 12. The linear velocity of the body 12 in the cylindrical portion 29 is greater than the linear velocity of the body 12 in the conical portions 30. The rotation of the body 12 will still result in the tumbling and cataracting described above, with the angle of the slope of the cone affecting the precise activity of the grinding media 28.

As the grinding media 28 typically has a generally rounded or spherical shape and is substantially smaller than the volume of the body 12, the grinding media 28 will tend to conform to the shape of the body 12, and therefore there tends to be more grinding media 28 in the area of the cylindrical portion 29 relative to the conical portions 30, and similarly less grinding media near the lower diameter end of the conical portion 30 and more grinding media near larger diameter areas of the conical portion 30. However, the total amount of grinding media 28 is still sufficient to contact and abrade the product to be milled.

Moreover, the product to be milled will similarly tend to conform to the shape of the body 12, with a greater amount of product to be milled being present in larger diameter areas than smaller diameter areas. Thus, while there is a lower amount of grinding media 28 in smaller diameter areas, there is also a lower amount of product to be milled. Accordingly, the milling process can still be performed with similar results to a cylindrical body.

During the rotation of the body during the milling process, the milled product will become finer as time goes on and it is continually abraded by the grinding media 28. The tapered shape of the conical portions 30, combined with gravity and the centrifugal forces acting against the conical portions 30, will cause the milled product to move toward the cylindrical portion 29, which includes the discharge grate 14. Thus, more milled product will tend to settle near the cylindrical portion relative to the conical portions 30.

Figure 12:
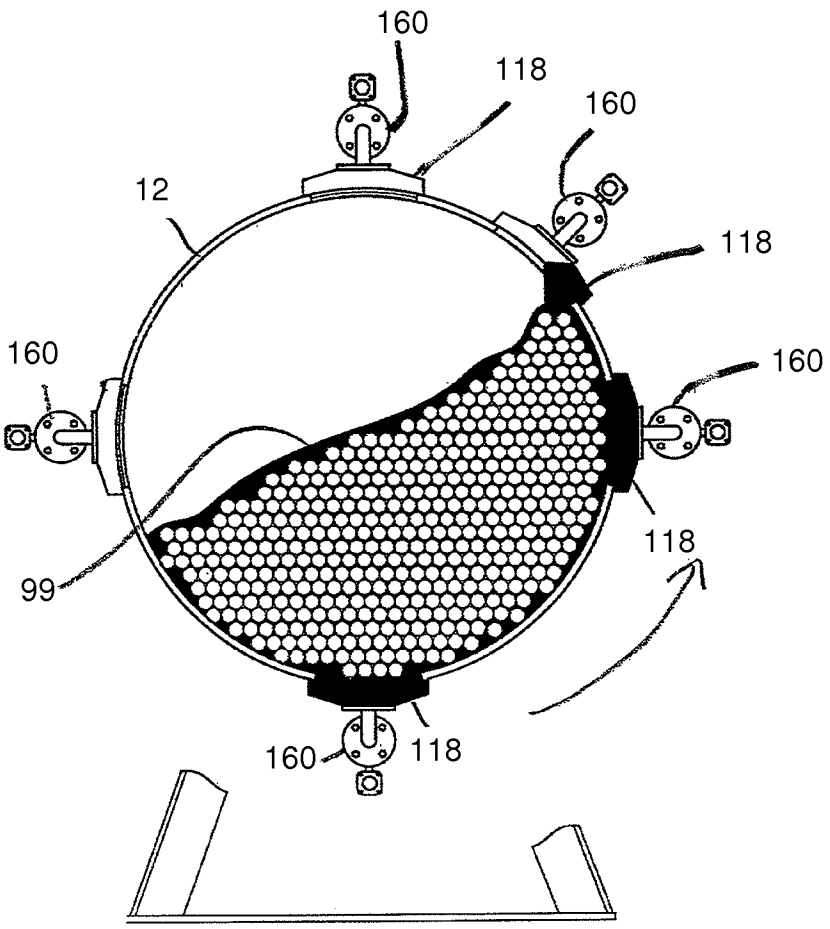
FIG. 12 is side cross-section view of the rotatable body having liquid medium therein and illustrating the second conveying system.

In the case of the conveying system 100, and with reference to FIG. 12, the discharge grate 14 remains open during the milling process and before the conveying process, allowing liquid medium 199 to flow between the housing 118 and body 12 during rotation.

The solid product to be milled is processed in a wet milling operation using the liquid medium 199 in addition to the solid product to be milled. In the wet milling operations, the solids are milled in the liquid medium 199 and the milled product is discharged as a liquid suspension or dispersion. The rotational speed of the body 12 will ultimately result in either the tumbling or cataracting described above, causing the grinding media 28 to be lifted and then fall or tumble to abrade the product.

When the body 12 is rotated, as shown in FIG. 12, the liquid medium 199 and milled product will flow through the grate 14 and into the housing 18 when the grate 14 and housing 118 are positioned below the central axis A. As the body 12 is rotated, the housing 118 will rotate upward and then ultimately downward. When the housing 118 is above the central axis A, the liquid medium and product will flow through the grate from the housing 118 back into the body 12. During rotation, rotational and inertia forces will result in some liquid medium and product remaining in the housing 118, even when the housing 118 is above the central axis A, as shown in FIG. 12. FIG. 12 shows various rotational positions of the housing 118 and valve 160 and illustrates the presence, or lack thereof, of the liquid medium 199 in the housing 118 at these various rotational positions.

At the conclusion of the rotation of the body 12 during the milling process, the body 12 will contain the product as either a dry solid in a fine particle form, or as a wet solid in a liquid medium. With rotation stopped, the body 12 will contain a greater amount of milled product near the cylindrical portion 29 than the conical portions 30. This is due to product moving toward the cylindrical portion 29 during rotation, as well as the cylindrical portion 29 defining a greater volume for holding the milled product and the grinding media relative to the smaller diameter conical portions 30, as well as gravity to cause the grinding media 28 and milled product to slide along the sloped conical portions 30 toward the cylindrical portion 29.

Depending on the type of milling operation (dry or wet), the product may require additional rotation of the body 12 during the conveying process. However, as described previously above, the conical portion 30 of the body 12 can reduce the amount of additional rotation needed relative to a fully cylindrical body to discharge the milled product because the tapered shape of the conical portions limits the need for "random walk" to discharge the milled product.

In the case of dry milling, the product may become trapped between individual members of the grinding media 28. The body 12 can be further rotated to loosen and free the product from the grinding media 28, if necessary.

In the case of liquid milling, if the liquid has a low viscosity, the liquid medium and the solid product contained in the liquid can generally flow through the grinding media 28 toward the bottom of the body 12 without requiring additional rotation. If the liquid is non-Newtonian or has a high viscosity, the body 12 may require additional rotation, similar to dry milling.

If the liquid has a low viscosity, the liquid medium and the solid milled product contained in the liquid can generally flow through the grinding media 28 toward the bottom of the body 12 without requiring additional rotation. Gravity will cause the liquid medium and solid milled product suspended therein to flow into the housing 18 and continue to flow into the housing as the housing 18 is evacuated during discharge. If the liquid is non-Newtonian or has a high viscosity, the body 12 may require additional rotation to allow the liquid medium and suspended milled product to travel toward and past the grate 14 and into the housing for discharge therefrom.

However, due to the sloped shape of the conical portions 30, gravity will cause the milled product to move toward the cylindrical portion 29 and the discharge grate more efficiently, requiring fewer additional rotations relative to a fully cylindrical body.

Additionally, even in the case of Newtonian liquid medium with low viscosity, the sloped shape of the conical portions 30 will allow gravity to more efficiently allow the liquid medium and milled product to move toward the discharge grate, reducing the amount of "heel" that might remain.

In the case of conveying system 100, if the chosen liquid medium does not generally require additional rotation of the body 12 to discharge the product, the body 12 is rotatably positioned such that the discharge grate 14 is at the bottom of the body 12. The liquid medium and suspended milled solids will flow into the housing 18 due to gravity. The valve 160 can be opened automatically or manually. In either case, the liquid medium and suspended milled product will pass through the grate 14 without exposing the operator or the surrounding environment to the milled product or solvent vapors. Rather, the product remains substantially contained within the housing 18 as it travels through the housing 18, outlet pipe 156, valve 160, and conveying pipe 120 to be discharged.

If the body 12 is required to rotate to discharge the milled product, for reasons described above, the valve 160 can remain in the open position allowing the liquid medium and suspended milled product to pass through the grate 14 and the housing and into the conveying pipe 120. During rotational discharging procedures, the liquid medium and product will discharge through the grate 14 and the housing 118 when liquid medium and milled product are present in the housing. When the housing 118 is positioned above the central axis A, there may not be any liquid medium or milled product remaining in the housing 118 after it had fallen back into the body 12. In these instances, the liquid medium and milled product will resume being discharged when the housing 118 returns to a position where gravity allows the liquid medium and milled product flow back into the housing 118.

The milled product will remain contained within the system 10 during this rotation. As described above, the valve 160 can be automatically opened via a pneumatic connection. The air delivery line to produce the pneumatic connection will rotate along with the body 12 during the rotation.

With reference now to both systems 53 and 100, while the liquid medium and/or milled product are being discharged through the grate 14 and into the conveying pipe 20, 120, the pipe 20, 120 can convey the milled product to the separator tank 88. More specifically, a vacuum or negative pressure can be applied to the conveying pipe 20, 120 from the blower or vacuum 91, 191 mounted to the tank 88, 188 when the vacuum 91, 191 is present in the system. The vacuum will be applied through the secondary pipe 86, 186, the rotary union 80, 180, and the conveying pipe 20, 120 to pull the milled product from the housing cavity 54, 154. This vacuuming of the milled product from the housing 18, 118 allows for the housing 18, 118 to be substantially smaller than the total volume of product that is discharged. In the case of the liquid discharge described herein, a slight vacuum is drawn to motivate fluid flow.

The vacuum applied through the conveying pipe 20, 120 can occur with the body 12 and housing 18, 118 either stationary or rotating. Because the conveying pipe 20, 120 and housing 18, 118 rotate along with the body 12, and the conveying pipe 20, 120 is coupled to the rotary union 80, 180, the negative pressure to retrieve the discharging product is not dependent on the body 12 rotating or remaining stationary.

Similarly, in addition to or alternative to the described vacuum produced by the vacuum 91, 191, the pump 98, 198 can be actuated to move the liquid medium and product through the system during discharge. The pump 98, 198 can be actuated either while the body 12 is stationary or while the body 12 is rotating.

Accordingly, the vacuum 91, 191 and pump 98, 198 can generally be referred to as a liquid-drawing apparatus or milled product drawing apparatus.

The use of a vacuum or negative pressure on the system 10, in addition to retrieving the product during the discharging process, can also be used to clean the system. The conveying pipe 20, 120 and secondary pipe 86, 186 can have a generally circular cross-section to limit the amount of build-up of product between the body 12 and the tank 88, 188.

Moreover, the use of negative pressure or a vacuum through the system 10 also limits instances of milled product escaping past a seal and into the surrounding area or into contact with an operator. Rather, the negative pressure will continue to pull milled product back into the system 10 in the event of a leak in one of the seals, in contrast to a system that forces air through a passageway that would push milled product out of a leaking seal or joint and into the surrounding area.

Additionally, to prevent build-up of product within the conveying pipe 20, 120, rotary union 80, 180, and secondary pipe 86, 186, these components can be made from tri-clamp sanitary connections that retain little milled product, and can be broken down and easily cleaned.

At the conclusion of the retrieval process, the valve 55, in the form of flap 56 or valve 160 can be closed, manually or automatically, to allow for another milling operation. The milled product can be retrieved from the separator tank 88, 188 in a manner known in the art.

In the above description regarding system 100, the system 100 has been described as having liquid medium within the body 12. The liquid medium can be added to the body 12 via the loading opening 40, along with the grinding media and product to be milled.

Figure 13:
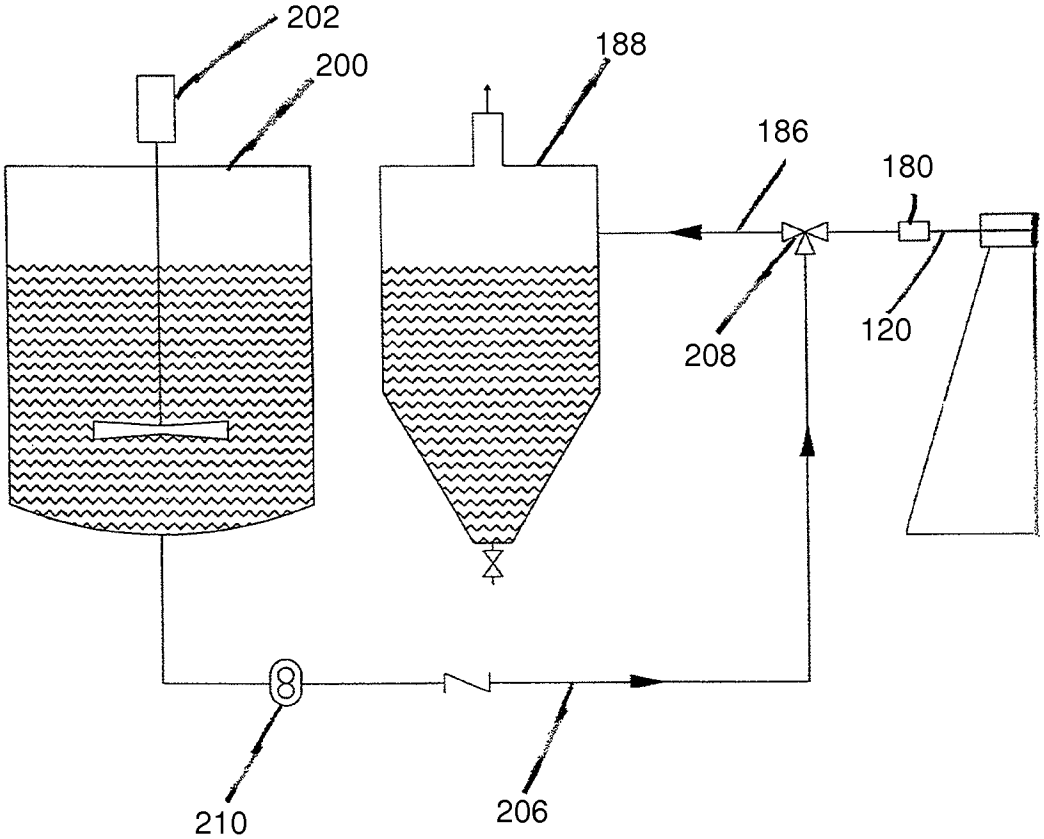
FIG. 13 is a schematic view of an alternative embodiment of the second conveying system including a liquid medium delivery pipe connected to the secondary pipe via a valve for delivering liquid medium toward the rotatable body.

In another approach, and with reference to FIG. 13, the liquid medium can be provided through the secondary pipe 186 and conveying pipe 120.

In this approach, the system 100 includes a second tank 200. The second tank 200 can be referred to as a pre-mix tank, where the liquid medium is present in the tank 200 and the product to be milled can be added to the tank 200, as well. A mixer 202 is operable to mix the liquid medium with the product to be milled. This is possible when the product to be milled is initially fine enough to be pre-mixed and pumped along with the liquid medium through the secondary pipe 186 and conveying pipe 120. In some instances, however, the product to be milled may be too large to stay in suspension within the liquid medium. In this case, the product to be milled can still be added to the body 12 through the loading opening 40 with the liquid medium supplied from the tank 200.

The system 100 can include a medium delivery pipe 206 that extends generally from the bottom of the tank 200 and intersects with the secondary pipe 186 at a location between the rotary union and the separator tank 188. The system includes a three-way valve 208 disposed on the secondary pipe 186 at the intersection of the secondary pipe 186 and the delivery pipe 206. The three-way valve 208 is operable to allow for liquid to flow from the conveying pipe 120 through the secondary pipe 186, through the valve 208, and toward the separator tank 188 during discharge. In this position, the valve 208 prevents liquid from flowing into the delivery pipe 206. The valve 208 is also operable to allow liquid to flow from the tank 200, through the delivery pipe 206, through the valve 208, and further through the secondary pipe 186 toward the conveying pipe 120 and ultimately to the body 12. In this position of the valve 208, liquid will not flow through the valve 208 toward the separator tank 188.

The system 10 also includes a second pump 210 disposed in line with the delivery pipe 206. The pump 210 can be of a type similar to those discussed above with reference to the pump 198, or other known pump types capable of pumping liquid. The pump 210 can be actuated manually or pneumatically.

Thus, the above described optional structure for delivering liquid medium provides an alternative to adding the liquid medium through the loading opening 40 or another location on the body 12. The above described structure remains generally fixed in place, and does not rotate along with the body 12.

In practice, to supply the liquid medium from the tank 200, the body 12 is preferably in a stationary position. Further, the body 12 is preferably rotated to a positon such that the discharge housing 118 is located above the axis A. This location of the discharge housing 118 is beneficial because it results in the grinding media being disposed generally below the discharge housing 118, from which the liquid medium will be entering the body 12. In this approach, the liquid medium will not have to flow against backpressure caused by gravity or by its flow through a tortuous path defined by the grinding media. However, the discharge housing 118 could also be located below the axis A when delivering the liquid medium into the body 12 if desired or if necessary.

While the above description relates to the body 12 being stationary during delivery of the liquid medium, the delivery of liquid medium from the tank 200 could also be performed while the body 12 is rotating, if desired or necessary.

To deliver the liquid medium, the valve 208 is set such that the delivery pipe 206 is in fluid communication with the secondary pipe 186, and the path toward the separator tank 188 is blocked. The valve 160 is similarly set to the open position to allow liquid medium to flow therethrough. The pump 210 is actuated, drawing liquid medium from the tank 200 and pumping it through the delivery pipe 206 toward the secondary pipe 186. Liquid will enter secondary pipe 186 and flow toward the rotary union 180, where it will then flow into the conveying pipe 120. The liquid medium will continue through the conveying pipe 120 and through the valve 160, where it will then enter the discharge housing 118. The liquid medium will then flow through the discharge grate 14, which is open to the cavity 26 of the body 12, and into the body 12.

When delivery of the liquid medium to the body 12 is complete, the pump 210 can be de-activated and valve 160 can be closed. Valve 208 can then be moved to the position where the delivery pipe 206 is blocked and flow through the secondary pipe 186 toward the separator tank 188 is re-established.

In one approach, the valve 208 is disposed between the pump 198 and the rotary union 180. In another approach, the valve 208 can be disposed between the pump 198 and the separator tank 188. In this approach, the pump 198 could be used to draw liquid from the tank 200 and through the delivery pipe 206 toward the conveying pipe 120 if the pump is capable of reversing the direction of the flow. The pump 198 can also be used to pump out liquid medium that was not ultimately delivered to the body 12 by pumping the liquid medium as if it were the liquid medium being discharged.

In the case where the pump 198 is between the valve 210 and separator tank 188, and not part of the path through which the liquid medium is delivered from the tank 200 to the body 12, the pump 210 could be used to pump liquid medium back into the tank 200 if the pump 210 is capable of two-direction pumping.

As a person skilled in the art will readily appreciate, the above description is meant as an illustration of implementation of the principles this invention. This description is not intended to limit the scope or application of this invention in that the invention is susceptible to modification, variation, and change, without departing from the spirit of this invention, as defined in the following claims.

What is claimed is:

1. A rotary milling system for using grinding media to create a milled product, the system comprising:

a rotatable body having a sidewall, a first end wall, and a second end wall, the body defining a cavity and a central longitudinal axis, the rotatable body configured to retain grinding media in contact with a portion of the sidewall;

the sidewall including a cylindrical portion and a variable diameter portion having an inner end and an outer end, wherein the variable diameter portion extends longitudinally between the cylindrical portion and the first end wall, the inner end of the variable diameter portion being disposed at the cylindrical portion and the outer end of the variable diameter portion being disposed at the first end wall;

an opening provided through the cylindrical portion of the sidewall to allow milled product to pass therethrough;

wherein the cylindrical portion has a first diameter and the first end wall has a second diameter, and the first diameter is greater than the second diameter;

wherein the opening is located radially further from the longitudinal axis than the outer end of the variable diameter portion;

wherein the diameter of the variable diameter portion decreases as it extends from the cylindrical portion to the first end wall; wherein the variable diameter defines a slope from the outer end toward the inner end in a range from 1 to 5 degrees to urge the grinding media and the milled product toward the opening.

2. The system of claim 1, further comprising a discharge grate attached to the cylindrical portion and extending across the opening to retain the grinding media within the body while allowing milled product to pass therethrough.

3. The system of claim 2, further comprising:

a discharge housing surrounding the discharge grate and defining a cavity therein;

a valve connected to an outlet of the discharge housing to selectively allow liquid medium and suspended solids therein to pass through the valve when open while preventing passage when closed;

a conveying pipe in fluid communication with an outlet side of the valve; and a liquid-drawing apparatus operatively associated with the conveying pipe and disposed downstream of the discharge housing to draw liquid medium in the conveying pipe away from the discharge housing.

4. The system of claim 2 further comprising:

a discharge housing attached to the body and surrounding the discharge grate and defining a cavity;

a flap disposed within the discharge housing; a conveying pipe in fluid communication with the discharge housing; and a negative pressure producing vacuum member operatively associated with the conveying pipe to create a negative pressure within the conveying pipe.

5. The system of claim 1, further comprising a removable cover mounted to the opening to seal the opening and prevent grinding media and milled product from exiting the cavity when installed and to permit grinding media and milled product to exit the body when removed.

6. The system of claim 1, wherein the second end wall has a diameter approximately equal to the diameter of the cylindrical portion.

7. The system of claim 1, wherein the cylindrical portion and opening are disposed adjacent the second end wall.

8. The system of claim 1, wherein the variable diameter portion is a first variable diameter portion, the system further comprising a second variable diameter portion having an inner end and an outer end, the second variable diameter portion extending from the cylindrical portion to the second end wall.

9. The system of claim 8, wherein the cylindrical portion and the opening are disposed at the longitudinal middle between the first and second end walls.

10. The system of claim 8, wherein the first and second variable diameter portions are disposed on opposite sides of the cylindrical portion and are symmetrical relative to the cylindrical portion.

11. The system of claim 8, wherein the variable diameter portions have different longitudinal lengths.

12. The system of claim 8, wherein the variable diameter portions have different shapes defining different slopes toward the cylindrical portion.

13. A rotary mill comprising:

a rotatable body having a sidewall, a first end wall, and a second end wall, the body defining a cavity and a central longitudinal axis, the rotatable body configured to retain grinding media in contact with a portion of the sidewall;

the sidewall including a cylindrical portion and a variable diameter portion having an inner end and an outer end, wherein the variable diameter portion extends longitudinally between the cylindrical portion and the first end wall, the inner end of the variable diameter portion being disposed at the cylindrical portion and the outer end of the variable diameter portion being disposed at the first end wall;

an opening provided through the cylindrical portion of the sidewall to allow milled product to pass therethrough;

wherein the cylindrical portion has a first diameter and the first end wall has a second diameter, and the first diameter is greater than the second diameter;

wherein the opening is located radially further from the longitudinal axis than the outer end of the variable diameter portion;

wherein the diameter of the variable diameter portion decreases as it extends from the cylindrical portion to the first end wall;

wherein the variable diameter defines a slope from the outer end toward the inner end in a range from 1 to 5 degrees to urge the grinding media and the milled product longitudinally toward the cylindrical portion and the opening;

a discharge grate attached the cylindrical portion and extending across the opening to retain the grinding media within the body while allowing milled product to pass therethrough;

a discharge housing attached to the body and surrounding the discharge grate;

a conveying pipe operatively coupled to the discharge housing for conveying milled product from the body;

a valve disposed in the flow path between the conveying pipe and the discharge grate;

wherein milled product is prevented from being conveyed through the conveying pipe when the valve is in a closed position and allowed to be conveyed through the conveying pipe when the valve is in an open position.

14. The system of claim 13 further comprising a rotary union connected with the conveying pipe.

15. The system of claim 14 further comprising: a milled product conveying apparatus in fluid communication with the conveying pipe for drawing milled product through the conveying pipe when the valve is in an open position; and a separator tank in fluid communication with the conveying pipe for receiving the conveyed milled product.

16. The system of claim 15 further comprising a secondary pipe connected to the rotary union, wherein the rotary union couples the secondary pipe and the conveying pipe and the secondary pipe is disposed between the separator tank and the conveying pipe.

17. A rotary milling system for using grinding media to create a milled product, the system comprising:

a rotatable body having a sidewall, a first end wall, and a second end wall, the body defining a cavity and a central longitudinal axis, the rotatable body configured to retain grinding media therein in contact with a portion of the sidewall;

the sidewall including a cylindrical portion and a variable diameter portion having an inner end and an outer end, wherein the variable diameter portion extends longitudinally between the cylindrical portion and the first end wall, the inner end of the variable diameter portion being disposed at the cylindrical portion and the outer end of the variable diameter portion being disposed at the first end wall;

an opening provided through the cylindrical portion of the sidewall to allow milled product to pass therethrough;

a discharge grate extending across the opening to retain grinding media within the body;

wherein the cylindrical portion has a first diameter and the first end wall has a second diameter, and the first diameter is greater than the second diameter;

wherein, when the body is oriented such that the opening and discharge grate are at a bottom of the body, the opening and discharge grate are located below an outer peripheral edge of the outer end of the variable diameter portion; and wherein the diameter of the variable diameter portion decreases as it extends from the cylindrical portion to the first end wall and the variable diameter defines a slope from the outer end toward the inner end in a range from 1 to 5 degrees to urge the grinding media and the milled product toward the cylindrical portion.

18. The system of claim 17, wherein the variable diameter portion of the body includes an inner surface and milled product flows along the inner surface radially outward and longitudinally toward the discharge grate during discharge.

* * * * *